US012018901B2

(12) United States Patent
Daniels et al.

(10) Patent No.: US 12,018,901 B2
(45) Date of Patent: Jun. 25, 2024

(54) UNIVERSAL HEAT EXCHANGER CABINET SYSTEM FOR A VERTICALLY MOUNTED HEAT EXCHANGER

(71) Applicant: Aerco International, Inc., Blauvelt, NY (US)

(72) Inventors: Mark Daniels, Valley Cottage, NY (US); Robert J. Battles, Pompton Lakes, NJ (US); Kyle T. Morgan, Mount Sinai, NY (US)

(73) Assignee: Aerco International, Inc., Blauvelt, NY (US)

( * ) Notice: Subject to any disclaimer, the term of this patent is extended or adjusted under 35 U.S.C. 154(b) by 221 days.

(21) Appl. No.: 17/173,297

(22) Filed: Feb. 11, 2021

(65) Prior Publication Data

US 2021/0254905 A1 Aug. 19, 2021

Related U.S. Application Data

(60) Provisional application No. 62/975,995, filed on Feb. 13, 2020.

(51) Int. Cl.
*F28F 9/00* (2006.01)
*F28D 1/04* (2006.01)

(52) U.S. Cl.
CPC ..... *F28F 9/002* (2013.01); *F28D 1/0452* (2013.01); *F28F 2009/004* (2013.01); *F28F 2280/06* (2013.01)

(58) Field of Classification Search
CPC ..... F28F 9/002; F24D 10/003; F24D 19/0097
See application file for complete search history.

(56) References Cited

U.S. PATENT DOCUMENTS 2,161,438 A * 6/1939 Terry ..... F24F 6/12 165/60

FOREIGN PATENT DOCUMENTS

| | | | | |
|---|---|---|---|---|
| DE | 10259462 A1 * | 7/2004 | ..... | F24D 10/003 |
| KR | 102029825 B1 * | 10/2019 | | |
| SE | 527545 C2 * | 4/2006 | ..... | F24D 10/003 |
| WO | WO-2010098657 A2 * | 9/2010 | ..... | F16L 11/118 |

OTHER PUBLICATIONS

"SmartPlate Water Heaters", Brochure, 2020, 8 pages, AERCO International Inc. Blauvelt, New York.
"Technical Data Sheet SmartPlate Double Wall Water-toWater Heater" Brochure, 2020, 2 pages, AERCO International Inc. Blauvelt, New York.

* cited by examiner

*Primary Examiner* — Eric S Ruppert
(74) *Attorney, Agent, or Firm* — Harris Beach PLLC

(57) ABSTRACT

A heat exchanger cabinet includes a base pallet. A heat exchanger base bracket of a selected fixed height or of an adjustable height bracket provides a support for a bottom of a heat exchanger, such that regardless of a height the heat exchanger, and within a range of different heat exchanger heights, a plurality of top mounted fluid inlets and outlets of the heat exchanger are disposed at about a same height above the base pallet. A set of heat exchanger base brackets, a stackable heat exchanger base bracket, a heat shield for a heat exchanger cabinet, and a heat exchanger cabinet for a vertically mounted heat exchanger are also described.

12 Claims, 32 Drawing Sheets

| DESCRIPTION | DIM. "A" |
|---|---|
| PIPING & HX 30 PLATES ASSY. 150 PSI | 17.55" |
| PIPING & HX 40 PLATES ASSY. 150 PSI | 16.55" |
| PIPING & HX 60 PLATES ASSY. 150 PSI | 14.49" |
| PIPING & HX 90 PLATES ASSY. 150 PSI | 11.42" |
| PIPING & HX 30 PLATES ASSY. 300 PSI | 17.55" |
| PIPING & HX 40 PLATES ASSY. 300 PSI | 16.55" |
| PIPING & HX 60 PLATES ASSY. 300 PSI | 14.49" |
| PIPING & HX 90 PLATES ASSY. 300 PSI | 11.42" |

FIG. 4A
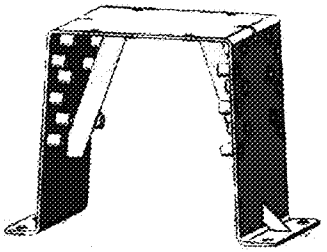
FIG. 4B
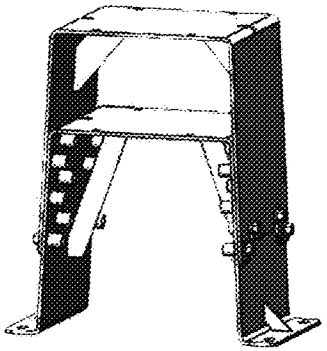
FIG. 4C
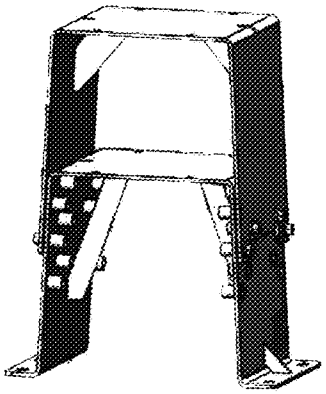
FIG. 4D
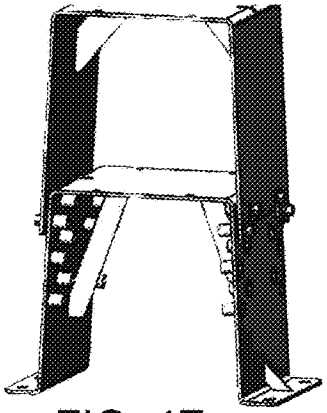
FIG. 4E

| DESCRIPTION | DIM. "A" |
|---|---|
| PIPING & HX 20 PLATES ASSY. 150 PSI | 17.55" |
| PIPING & HX 40 PLATES ASSY. 150 PSI | 16.55" |
| PIPING & HX 60 PLATES ASSY. 150 PSI | 14.46" |
| PIPING & HX 80 PLATES ASSY. 150 PSI | 11.42" |
| PIPING & HX 20 PLATES ASSY. 200 PSI | 17.55" |
| PIPING & HX 40 PLATES ASSY. 200 PSI | 16.55" |
| PIPING & HX 60 PLATES ASSY. 200 PSI | 14.46" |
| PIPING & HX 80 PLATES ASSY. 200 PSI | 11.42" |

UNIVERSAL HEAT EXCHANGER CABINET SYSTEM FOR A VERTICALLY MOUNTED HEAT EXCHANGER

CROSS-REFERENCE TO RELATED APPLICATIONS

This application claims priority to and the benefit of U.S. provisional patent application Ser. No. 62/975,995, UNIVERSAL HEAT EXCHANGER CABINET, NESTABLE HEAT EXCHANGER BASE BRACKET SET, TWO-PART ADJUSTABLE BASE BRACKETS, AND HEAT SHIELD, filed Feb. 13, 2020, which application is incorporated herein by reference in its entirety.

FIELD OF THE APPLICATION

The application relates to heat exchangers and particularly to heat exchanger cabinets.

BACKGROUND

Heat exchangers transfer heat from a first heated fluid or gas to heat another isolated second gas or fluid. Water systems increasingly use heat exchangers to supply a domestic hot water for a home or building. Heat exchangers can be mounted in a heat exchanger cabinet. Because heat exchangers are manufactured in variety of different physical sizes, for example different heights, a custom sized cabinet is typically made for each particular heat exchanger type and height.

SUMMARY

A heat exchanger cabinet includes a base pallet. A heat exchanger base bracket of a selected fixed height or of an adjustable height bracket provides a support for a bottom of a heat exchanger, such that regardless of a height the heat exchanger, and within a range of different heat exchanger heights, a plurality of top mounted fluid inlets and outlets of the heat exchanger are disposed at about a same height above the base pallet.

The heat exchanger cabinet can further include a pair of heat exchanger side support brackets.

The heat exchanger base bracket can include the adjustable height bracket having a bottom bracket adjustably nested under a top bracket to set a desired height of the heat exchanger base bracket. The bottom bracket can include at least one adjusting slot. At least one bracket can include an adjustable locking tooth mechanism. The adjustable locking tooth mechanism can include at least one threaded nut having teeth which engage a row of teeth of the adjustable locking tooth mechanism to lock a desired adjustable bracket height.

At least one bracket part can include a pair of diagonal supports which for nesting stowage fit into bracket top slots for compact stacking by nesting. The pair of diagonal supports so interlaced into bracket top slots provide an improved stability of a stack of brackets when so nestingly stowed.

The heat exchanger cabinet can further optionally include one or more skirt portions covering at least one side of the base pallet.

A set of heat exchanger base brackets include at least one of each of three types of brackets including: a fixed height heat exchanger bracket, a bottom bracket having a plurality of levels of different height mounting holes which can also be used as a fixed height bracket, and a top bracket having a plurality of mounting holes or bottom slots at or near a lower edge of each side of the top bracket for mounting to either side of the bottom bracket having a plurality of levels of height adjustment positions. When the bottom bracket having the plurality of levels of height adjustment positions is used as a part of a two-part adjustable bracket, the number of selectable base bracket settable heights is greater than three.

At least one bracket part can include a pair of diagonal supports which for nesting stowage fit into bracket top slots for compact stacking by nesting.

The two-part adjustable bracket can include the bottom bracket having the plurality of levels of height adjustment positions in combination with the top bracket. The plurality of levels of height adjustment positions can include an adjusting slot. At least one bracket can include a toothed locking mechanism. The toothed locking mechanism can include at least one threaded nut having teeth which engage a row of teeth of the toothed locking mechanism to lock a desired adjustable bracket height.

A stackable heat exchanger base bracket includes a pair of stackable heat exchanger base bracket sides. A top surface includes a stacking slot at either side of the top surface. Each diagonal brace of a pair of diagonal braces is mechanically coupled from a lower inside surface of the top surface, to an interior wall of a lower portion of each side, or extends through a slot in the interior wall of the lower portion of each side, to a horizontal mounting flange extending horizontally outward from a bottom of each side. On stacking or nesting the stackable heat exchanger base brackets, the pair of diagonal braces rests at least in part within the stacking slots of a heat exchanger base bracket below.

A heat shield for a heat exchanger cabinet system includes a forward lower skirt. An about flat or low angle surface front to rear extends above and from the forward lower skirt. An about vertical chimney sheet extends above and from the about flat or low angle surface front to rear. An upper rear discharge fin extends above and from the about vertical chimney sheet.

The upper rear discharge fin can include an angled surface with respect to a plane defined by the about vertical chimney sheet of other than a right angle.

The heat shield can further include mounting ears at either side of a forward portion of the about flat or low angle surface front to rear.

A heat exchanger includes a base pallet. A plurality of heat exchanger connecting pipes of a selected fixed height provide fluid connections to a vertically mounted heat exchanger, such that regardless of a height the vertically mounted heat exchanger, within a range of different heat exchanger heights, a plurality of heat exchanger cabinet top mounted fluid inlets and outlets are disposed at about a same height above said base pallet.

The foregoing and other aspects, features, and advantages of the application will become more apparent from the following description and from the claims.

BRIEF DESCRIPTION OF THE DRAWINGS

The features of the application can be better understood with reference to the drawings described below, and the claims. The drawings are not necessarily to scale, emphasis instead generally being placed upon illustrating the principles described herein. In the drawings, like numerals are used to indicate like parts throughout the various views.

FIG. 4A is a drawing showing a first height mounting bracket using the fixed height bracket of FIG. 1;

FIG. 4B is a drawing showing a second height mounting bracket which has height greater than the height of the heat exchanger mounting bracket of FIG. 4A using the bottom bracket of FIG. 2;

FIG. 4C is a drawing showing a second height mounting bracket which has height greater than the height of the heat exchanger mounting bracket of FIG. 4B using the bottom bracket of FIG. 2 combined with the top bracket of FIG. 3 mounted in the two-part mounting bracket (c) configuration;

FIG. 4D is a drawing showing a second height mounting bracket which has height greater than the height of the heat exchanger mounting bracket of FIG. 4C using the bottom bracket of FIG. 2 combined with the top bracket of FIG. 3 mounted in the two-part mounting bracket (b) configuration;

FIG. 4E is a drawing showing a second height mounting bracket which has height greater than the height of the heat exchanger mounting bracket of FIG. 4D using the bottom bracket of FIG. 2 combined with the top bracket of FIG. 3 mounted in the two-part mounting bracket (a) configuration;

DETAILED DESCRIPTION

Heat exchangers used as water heaters can be mounted such that a plurality of pipes fluidly couple to the top of the heat exchanger. A substantially universal heat exchange package can position various sized heat exchangers with similar top pipe connections at about the same height above the ground, where the heat exchange package typically sits on the ground or more commonly on a mounting pallet which sits on the ground at floor level. One advantage of such a heat exchanger packaging approach is that substantially the same cabinet can be used across a variety of heat exchanger sizes, which can differ in height, such as by water heating capacity. Another advantage of plumbed connections at substantially the same height across a product line range of heating capacity is that should a different size heating capacity be found to be more appropriate for a given installation, any one of a suitable, or most available, heat exchanger unit from the product line can be installed, substituted, or replaced without needing to re-plumb the direction or lengths of the pipes to and from the heat exchanger.

What is needed is an in-cabinet heat exchanger support device which allows different height heat exchangers to be mounted in the same cabinet design so that the top plumbed connections at the top of the heat exchanger are at substantially the same height from the bottom of the cabinet which sits on the floor or on a pallet on the floor, no matter which specific model heat exchanger of a same series of heat exchangers (typically with different heating capacities) is used.

Also, according to the new in-cabinet heat exchanger support device, there can be such a device which nestingly stacks for ease of storage/stowage including compact stacking of the parts both in storage and near the assembly line where the parts are placed before assembly into the cabinet and assembly of the heat exchanger on top of the in-cabinet heat exchanger support device.

Any suitable set of fixed length heat exchanger supports, adjustable length heat exchanger supports, and combinations thereof can be used. For example, there can be fixed, adjustable, or combinations thereof, blocks, brackets, posts, rods, cylinders, etc. of varying sizes which cause a variety of heat exchangers with top plumbed connections to be mounted in a cabinet such that despite the variation in heights of the different model heat exchangers (typically having different heating capacities), where the top plumbed connections are at substantially the same height above the floor. It is unimportant if the cabinet sits on the floor or on a pallet, only that the location of the pipe connections at the top of the heat exchanger be about the same distance from the floor with respect to the building plumbed connections.

Heat Exchanger Support Brackets

Figure 1:
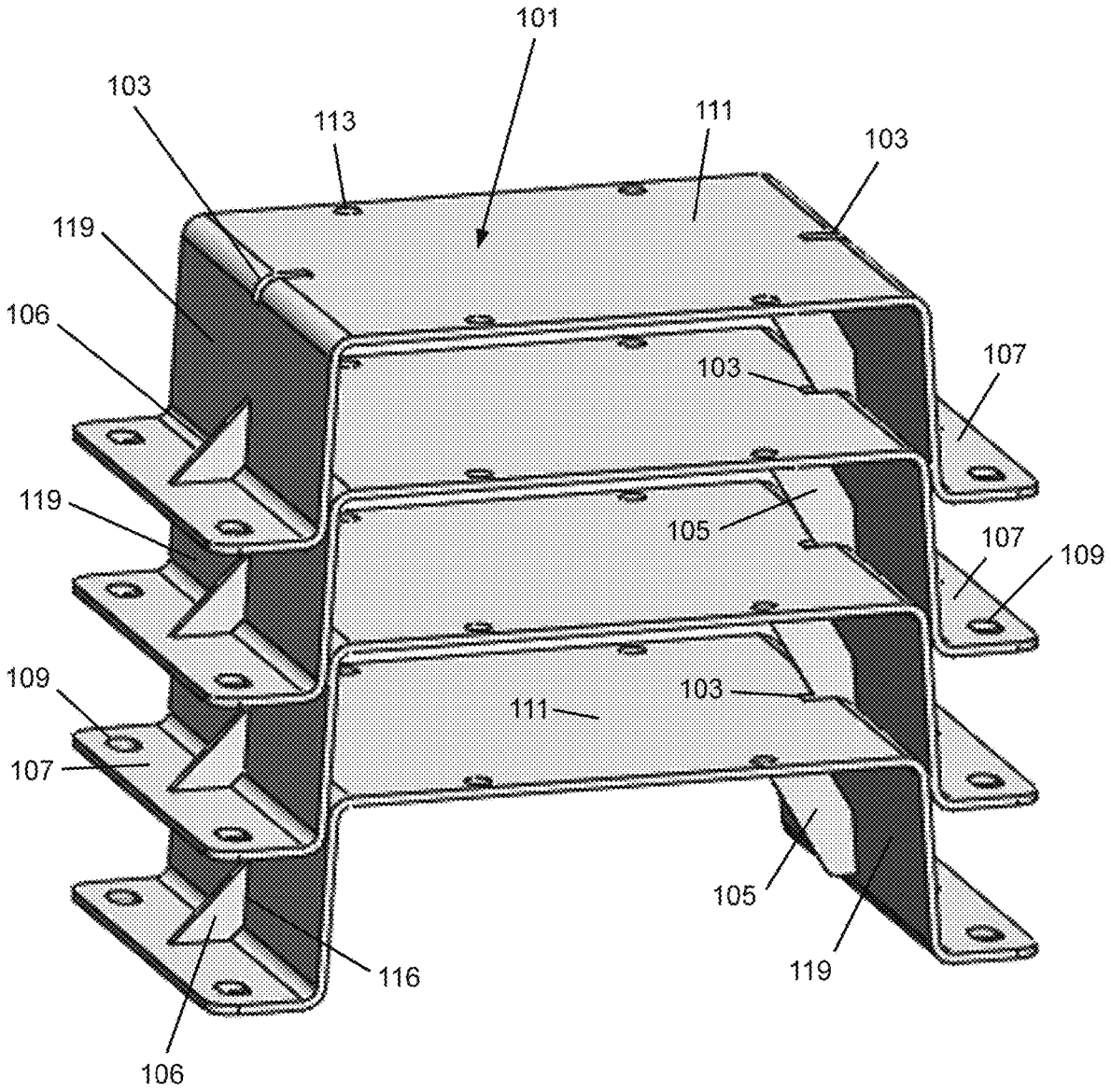
FIG. 1 is a drawing showing a stack of four exemplary fixed height brackets nested for storage according to the Application.

FIG. 1 is a drawing showing a stack of four exemplary fixed height brackets according to the Application. FIG. 1 shows a first bracket of fixed height which can be used mount a heat exchanger in a cabinet such that the plumbed connections at the top of the heat exchanger are at a pre-determined height above the floor.

The fixed height bracket 101 of FIG. 1 also includes a new stacking feature, where diagonal supports 105 of each bracket fit into bracket top slots 103 for compact stacking by nesting. Moreover, the interlaced diagonal supports 105 in bracket top slots 103 provide improved stability of a stack of brackets when so nestingly stowed.

The height of fixed height bracket 101 is determined by the distance from the bottom surface of the mounting flange 107 to the top side of the bracket top surface 111, as set by the length of fixed height bracket sides 119.

The mounting flange 107 can include any suitable number and pattern of mounting holes 109 which are typically used to screw or bolt the mounting flange 107 to a bottom of the heat exchanger cabinet, a surface underneath the heat exchanger cabinet such as a surface of a pallet mount, or combinations thereof.

The lower part of the heat exchanger can be screwed or bolted to the bracket top surface 111 such as by use of bracket top mounting holes 113.

Instead of, or more likely in addition one or more different sizes of fixed height brackets such as the exemplary fixed height bracket 101 of FIG. 1, there can be brackets which include an adjustable height feature. While such brackets can be telescoping, or adjustable by a threaded rod or piston, an adjustable height heat exchanger bracket can be settable by a range of overlap of a two-part bracket device.

Figure 2:
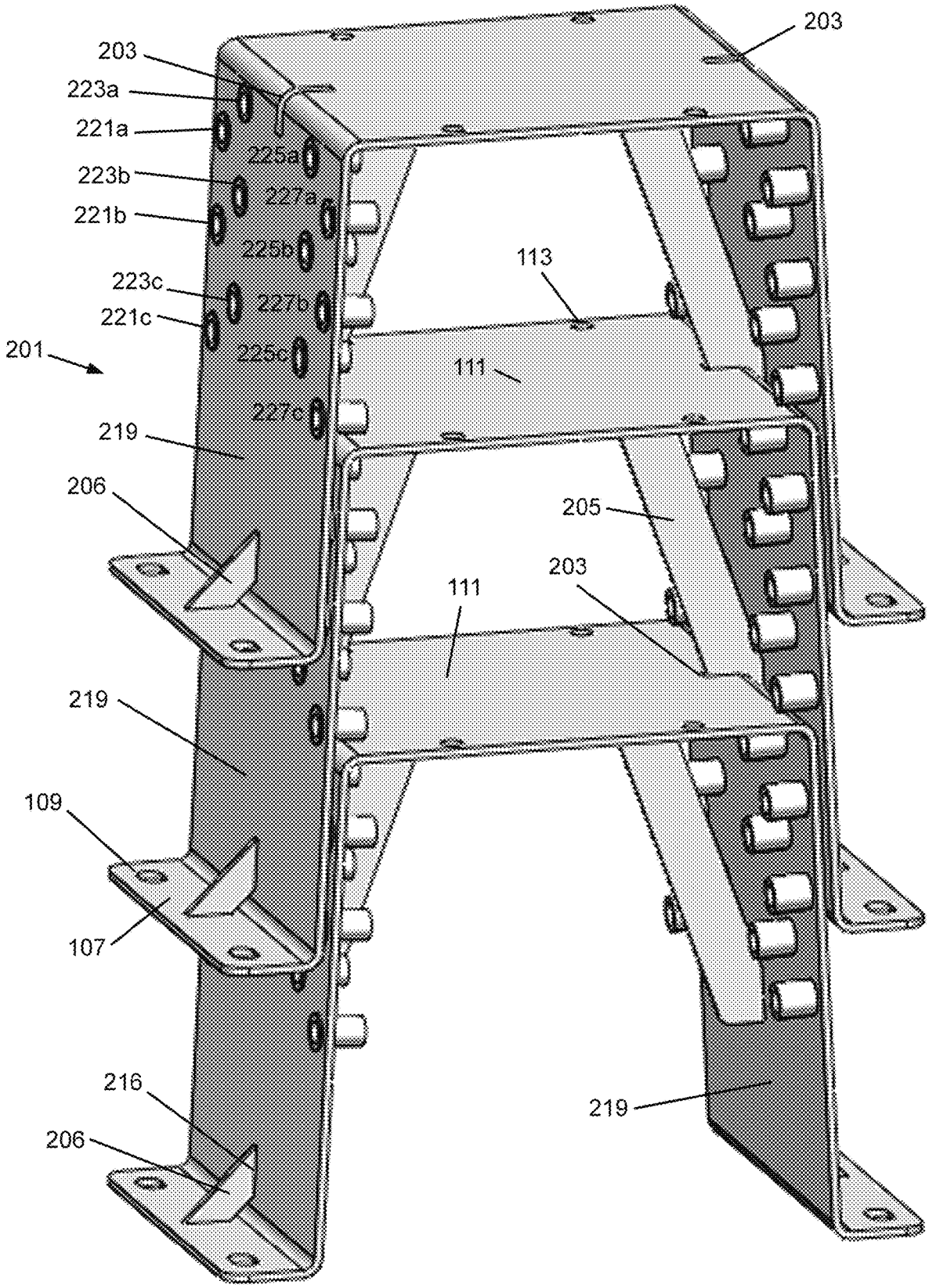
FIG. 2 is a drawing showing four of the lower part brackets of an exemplary two-part adjustable height mounting bracket nested for storage according to the Application.

FIG. 2 is a drawing showing the lower bottom part bracket 201 of an exemplary two-part adjustable height bracket.

The bottom part bracket 201 is similar to the fixed height bracket 101 of FIG. 1. As in FIG. 1, the mounting flange 107 can include any suitable number and pattern of mounting holes 109 which are typically used to screw or bolt the mounting flange 107 to a bottom of the heat exchanger cabinet, a surface underneath the heat exchanger cabinet such as a surface of a pallet mount, or combinations thereof. Also, mounting bracket 201 can be used as a fixed height bracket, where the lower part of the heat exchanger can be screwed or bolted to the bracket top surface 111 such as by use of bracket top mounting holes 113.

Also, the bottom part bracket 201 of FIG. 2 includes the new stacking feature, where diagonal supports 205 of each bracket fit into bracket top slots 203 for compact stacking by nesting. The interlaced diagonal supports 205 in bracket top slots 203 can provide improved stability of a stack of brackets when so nestingly stowed.

The diagonal support 205 can be continuous through the side wall 219 including the outside diagonal member 206 which mechanically coupled to the mounting flange 107. Or the diagonal support 205 can mechanically couple to the inside of the side wall 219, where the outside diagonal member 206 is a separate relatively short diagonal member disposed between the outside of side wall 219 and the mounting flange 107.

What is different about the bottom part bracket 201 of FIG. 2 are the sets of nesting holes on the side wall 219. The sets include (a) 221*a*, 223*a*, 225*a*, and 227*a*, (b) 221*b*, 223*b*, 225*b*, and 227*b*, and (c) 221*c*, 223*c*, 225*c*, and 227*c*. Each set, (a), (b), and (c) is for screwing or bolting a second top part of a mounting bracket on top of the exemplary lower part of the two-part bracket as shown in FIG. 2. It should be noted that the hole patterns 221, 223, 225, and 227 are merely exemplary, and that other hole patterns can be used. Moreover, while the exemplary adjustable two-part bracket based on the lower part of FIG. 2, shows three adjustable heights, any suitable number of adjustable heights can be used (e.g. (a), (b), (c), (d) (n)), and there can be as few as one or two height settings for the top part as well (e.g. just (a), or (a) and (b)).

Figure 3:
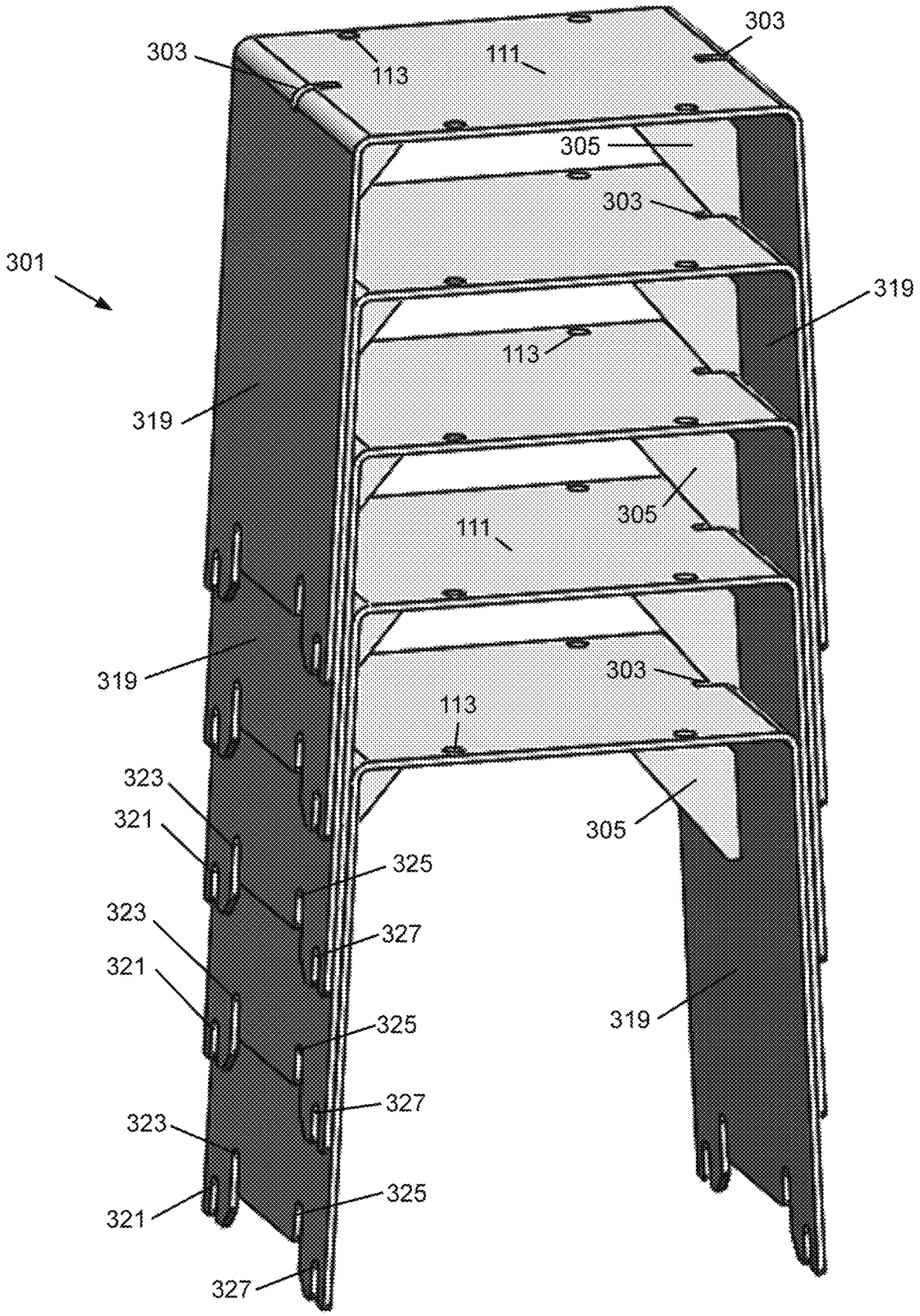
FIG. 3 is a drawing showing four of the top part brackets of an exemplary two-part adjustable height mounting bracket nested for storage according to the Application.

Now turning to FIG. 3, the top part of the two-part adjustable bracket is described in more detail. FIG. 3 is a drawing showing an exemplary top part of a two-part mounting bracket to be used in conjunction with the bottom part of the two-part mounting bracket of FIG. 2.

The top part bracket 301 is slightly different from the fixed height bracket of FIG. 1 and the bottom part bracket 201 of FIG. 2 in that it does not include a mounting flange 107, and rather is only used a top part of an adjustable two-part mounting bracket.

However, similar to the fixed height bracket of FIG. 1 and the bottom part bracket 201 of FIG. 2, the top part bracket 301 does stack by interlacing diagonal supports 305 into top slots 303 when a number of top part brackets 301 are nestingly stacked. The interlaced diagonal supports 305 in bracket top slots 303 can similarly provide improved stability of a stack of brackets when so nestingly stowed.

The bottom slots 321, 323, 325, and 327 are disposed so that a screw or bolt can be placed through each of the four slot openings which correspond to a height setting (a), (b), or (c) of the lower bottom part bracket 201 of FIG. 2. Note that the cylinders shown in FIG. 2 represent one exemplary threaded rivet which can accept threaded machined screws or bolts through each of the slots into each of the threaded cylinders to secure the top part bracket 301 to the bottom bracket 201 at one of the exemplary selectable heights (a), (b), or (c). Any suitable threaded part can be use, such as the illustrated threaded rivet, PEM™ nuts, etc. Or, sheet metal screws can be used as well through threaded holes in the bottom part 201, or by self-threading metal screws turning into suitably sized holes.

FIG. 4A is a drawing showing a first height mounting bracket using the fixed height bracket of FIG. 1.

FIG. 4B is a drawing showing a second height mounting bracket which has height greater than the height of the heat exchanger mounting bracket of FIG. 4A using the bottom bracket of FIG. 2.

FIG. 4C is a drawing showing a second height mounting bracket which has height greater than the height of the heat exchanger mounting bracket of FIG. 4B using the bottom bracket of FIG. 2 combined with the top bracket of FIG. 3 mounted in a two-part mounting bracket (c) configuration.

FIG. 4D is a drawing showing a second height mounting bracket which has height greater than the height of the heat exchanger mounting bracket of FIG. 4C using the bottom bracket of FIG. 2 combined with the top bracket of FIG. 3 mounted in a two-part mounting bracket (b) configuration.

FIG. 4E is a drawing showing a second height mounting bracket which has height greater than the height of the heat exchanger mounting bracket of FIG. 4D using the bottom bracket of FIG. 2 combined with the top bracket of FIG. 3 mounted in a two-part mounting bracket (a) configuration.

The flexibility of adjustment of just the three different mechanical three parts, the fixed height bracket 101, the bottom part bracket 201, and the top part bracket 301 can be better understood in terms of the number of different height heat exchangers which can be supported so that the top of the heat exchanger is about the same height above the floor. The possible combinations are as follows: 1) fixed height bracket 101, FIG. 4A, 2) bottom part bracket 201 alone, acting similar to the fixed height bracket 101, but with side walls 219 longer than side walls 119, FIG. 4B, 3) the two-part mounting bracket where the top part bracket 301 is affixed to the bottom part bracket 201 at height position (c), FIG. 4C, 4) the two-part mounting bracket where the top part bracket 301 is affixed to the bottom part bracket 201 at height position (b), FIG. 4D, and 5) the two-part mounting bracket where the top part bracket 301 is affixed to the bottom part bracket 201 at height position (a), FIG. 4E. It can now be seen that from three manufactured height brackets, five different heat exchanger heights can be accommodated in substantially the same heat exchanger cabinet. Also, the substantially the same plumbing connections can be used at substantially the same height above the floor.

Figure 5:
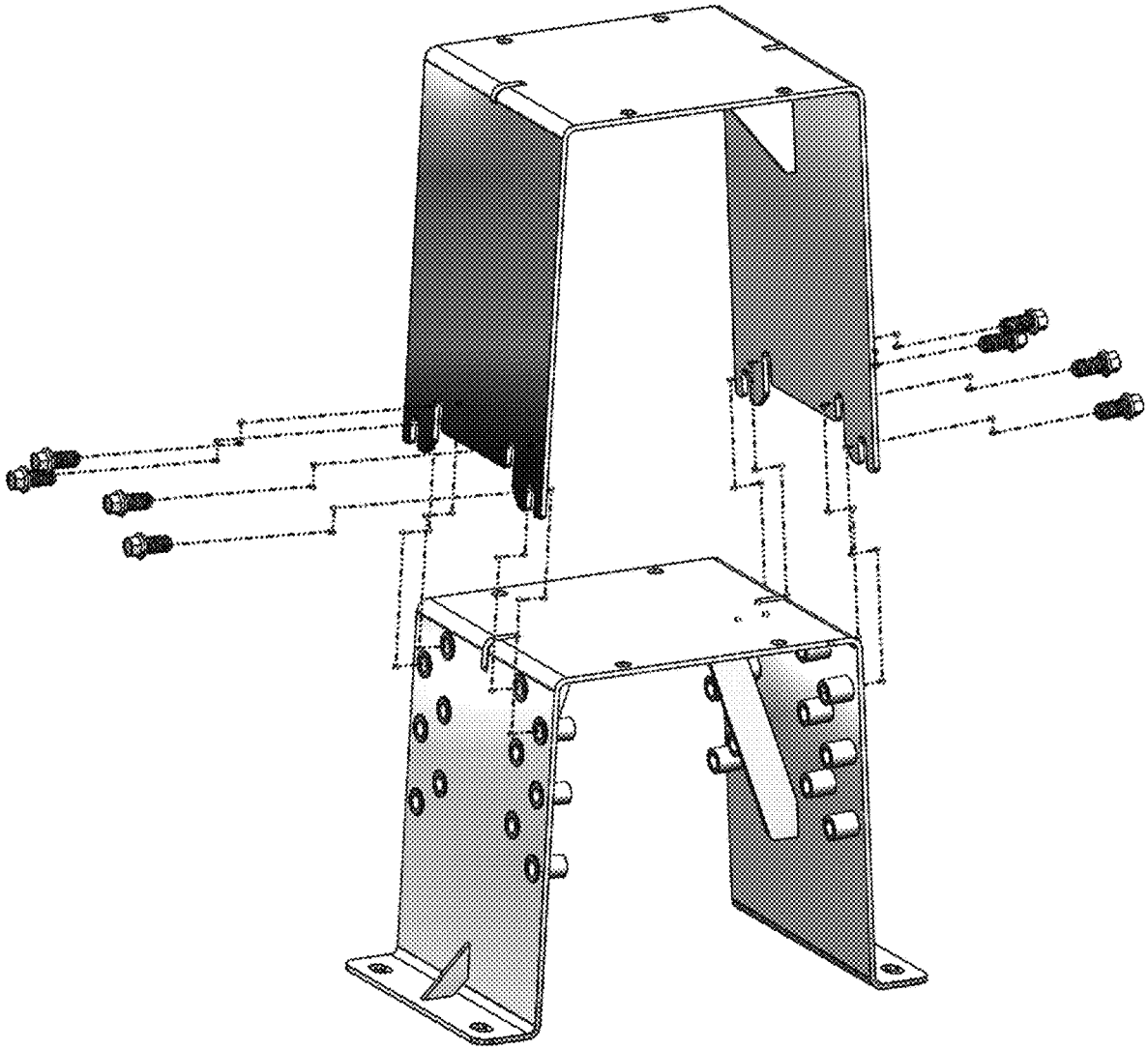
FIG. 5 is a drawing showing a two-part adjustable bracket according to FIG. 2 and FIG. 3.

FIG. 5 is a drawing showing a two-part adjustable bracket according to FIG. 2 and FIG. 3. The dotted lines show the two-part adjustable bracket being assembled to an (a) height as shown in FIG. 4E.

Figure 6:
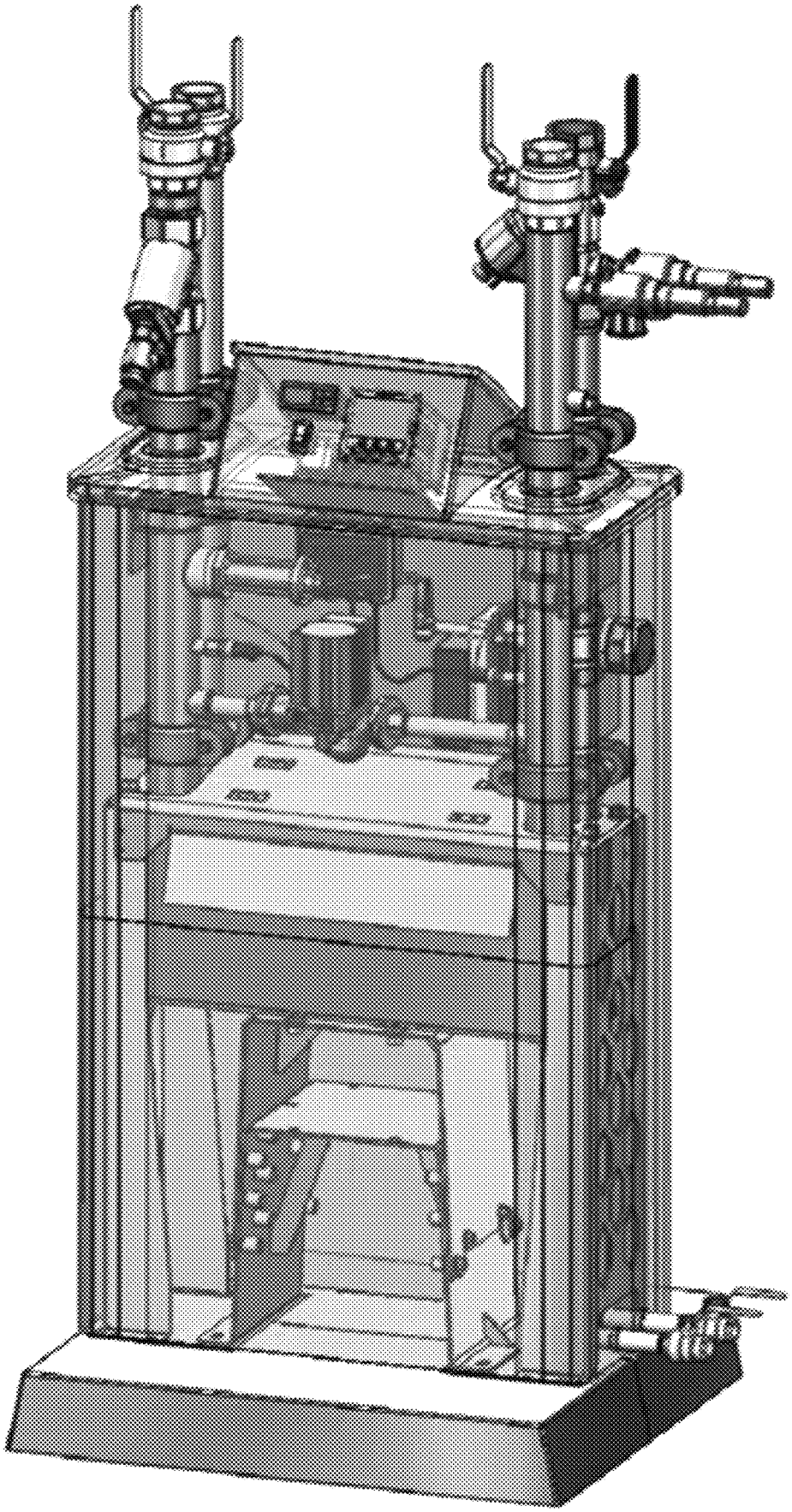
FIG. 6 is a drawing showing a heat exchanger mounted on a two-part adjustable bracket being assembled to a (c) height as shown in FIG. 4C.

FIG. 6 is a drawing showing a heat exchanger mounted on a two-part adjustable bracket being assembled to a (c) height as shown in FIG. 4C.

Figure 7:
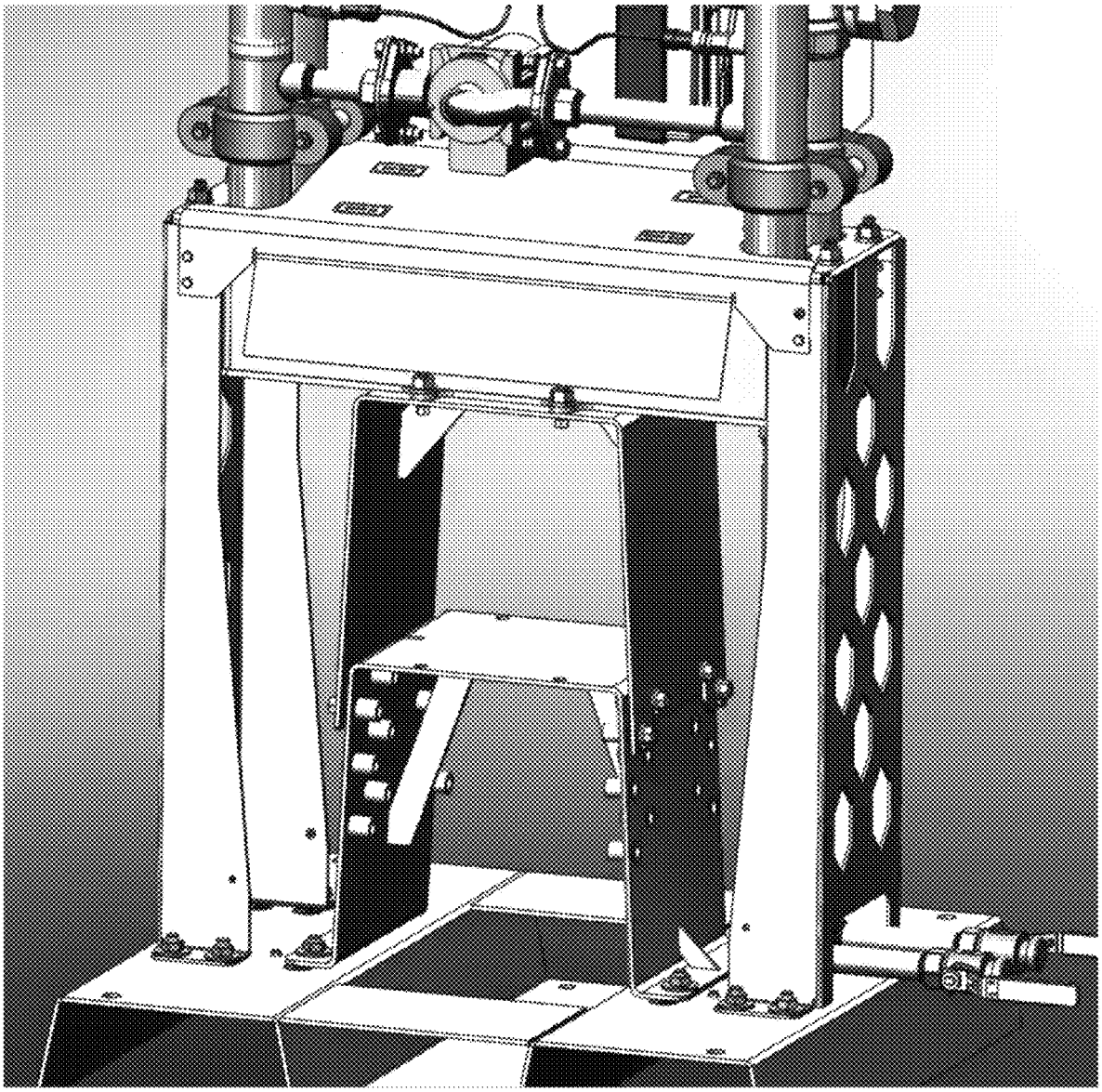
FIG. 7 is a drawing showing another heat exchanger shorter than the heat exchanger of FIG. 6, mounted on a two-part adjustable bracket being assembled to an (a) height as shown in FIG. 4E.

FIG. 7 is a drawing showing another heat exchanger shorter than the heat exchanger of FIG. 6, mounted on a two-part adjustable bracket being assembled to an (a) height as shown in FIG. 4E.

Figure 8:
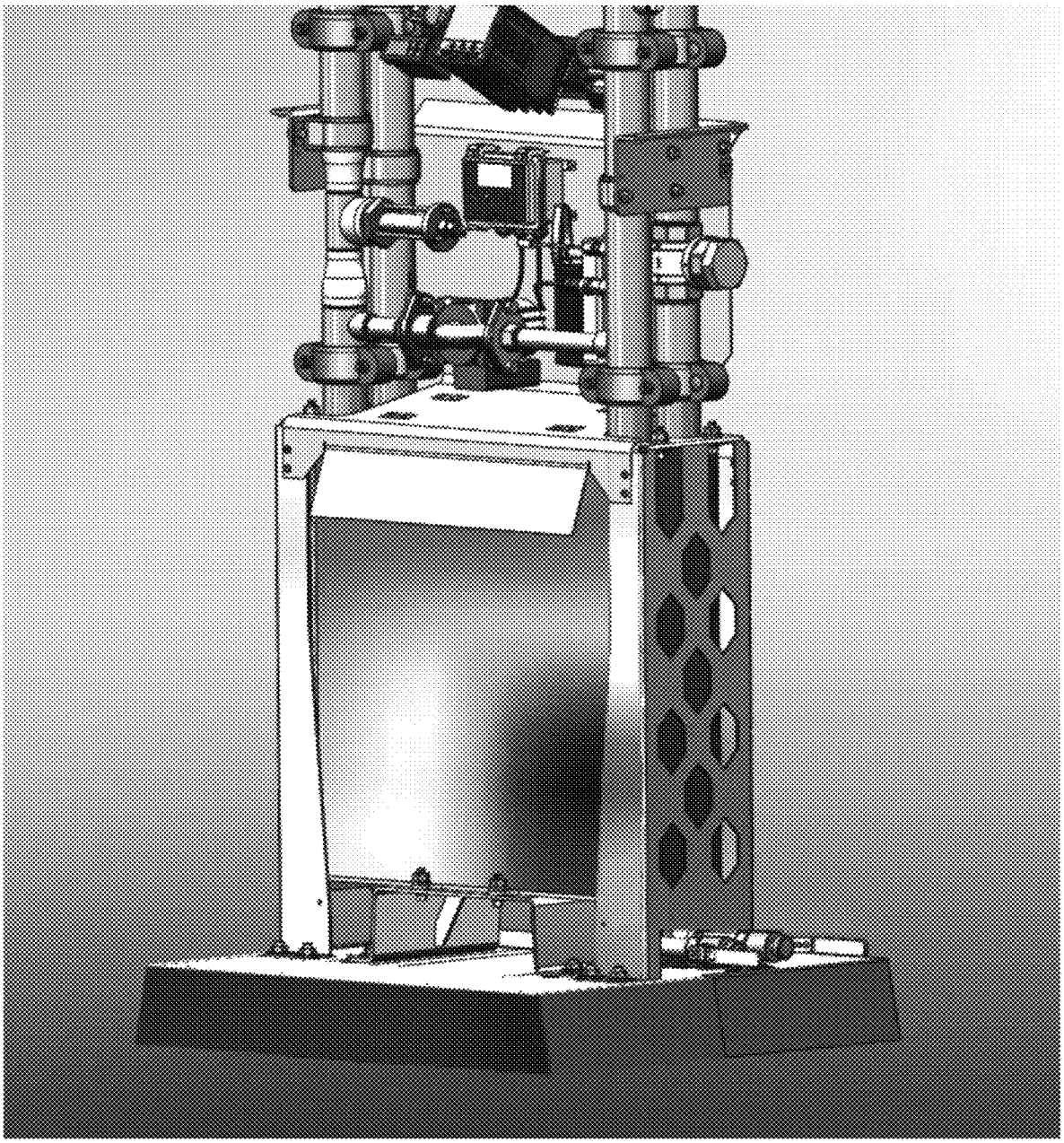
FIG. 8 is a drawing showing another heat exchanger taller than the heat exchanger of FIG. 6, mounted on a fixed height bracket similar to the bracket of FIG. 1 and FIG. 4A.

FIG. 8 is a drawing showing another heat exchanger taller than the heat exchanger of FIG. 6, mounted on a fixed height bracket similar to the bracket of FIG. 1 and FIG. 4A.

A heat exchanger cabinet includes a base pallet (FIG. 6, FIG. 7, FIG. 8, FIG. 13C). A heat exchanger base bracket of a selected fixed height or of an adjustable height bracket provides a support for a bottom of a heat exchanger, such that regardless of a height the heat exchanger, and within a range of different heat exchanger heights, a plurality of top mounted fluid inlets and outlets of the heat exchanger are disposed at about a same height above the base pallet.

Figure 9D:
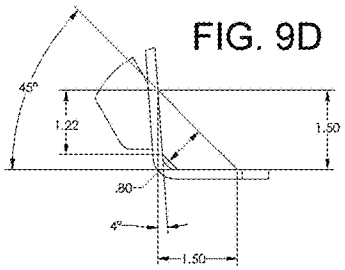
FIG. 9D is a drawing showing a bend angle of the fixed height bracket of FIG. 9A.
Figure 9E:
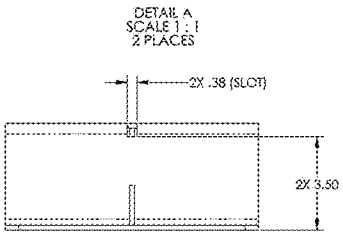
FIG. 9E is a drawing showing a side view of the fixed height bracket of FIG. 9A.
Figure 9F:
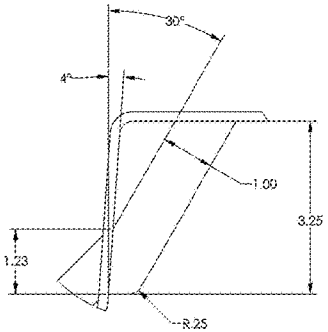
FIG. 9F is a drawing showing another bend angle view of the fixed height bracket of FIG. 9A.
Figure 9A:
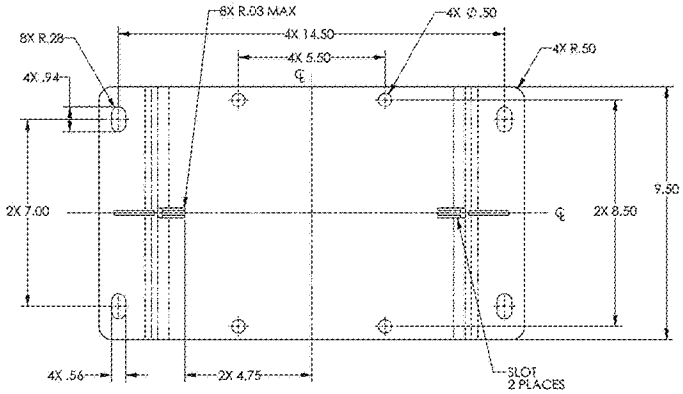
FIG. 9A is a drawing showing a top view of an exemplary fixed height bracket according to FIG. 1.
Figure 9B:
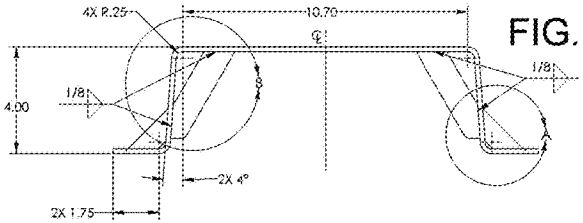
FIG. 9B is a drawing showing a front view of the fixed height bracket of FIG. 9A.
Figure 9C:
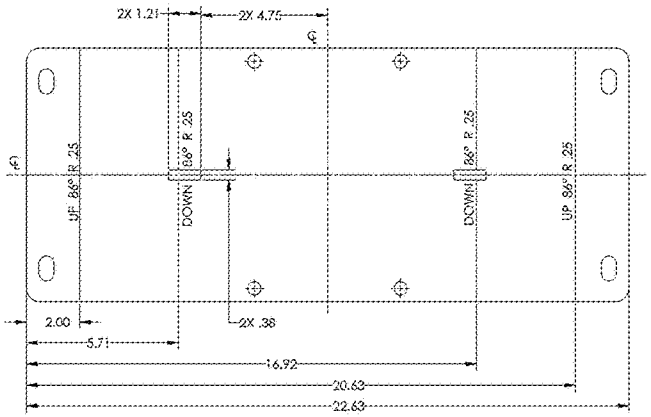
FIG. 9C is a drawing showing a flat pattern view of the fixed height bracket of FIG. 9A.
Figure 9G:
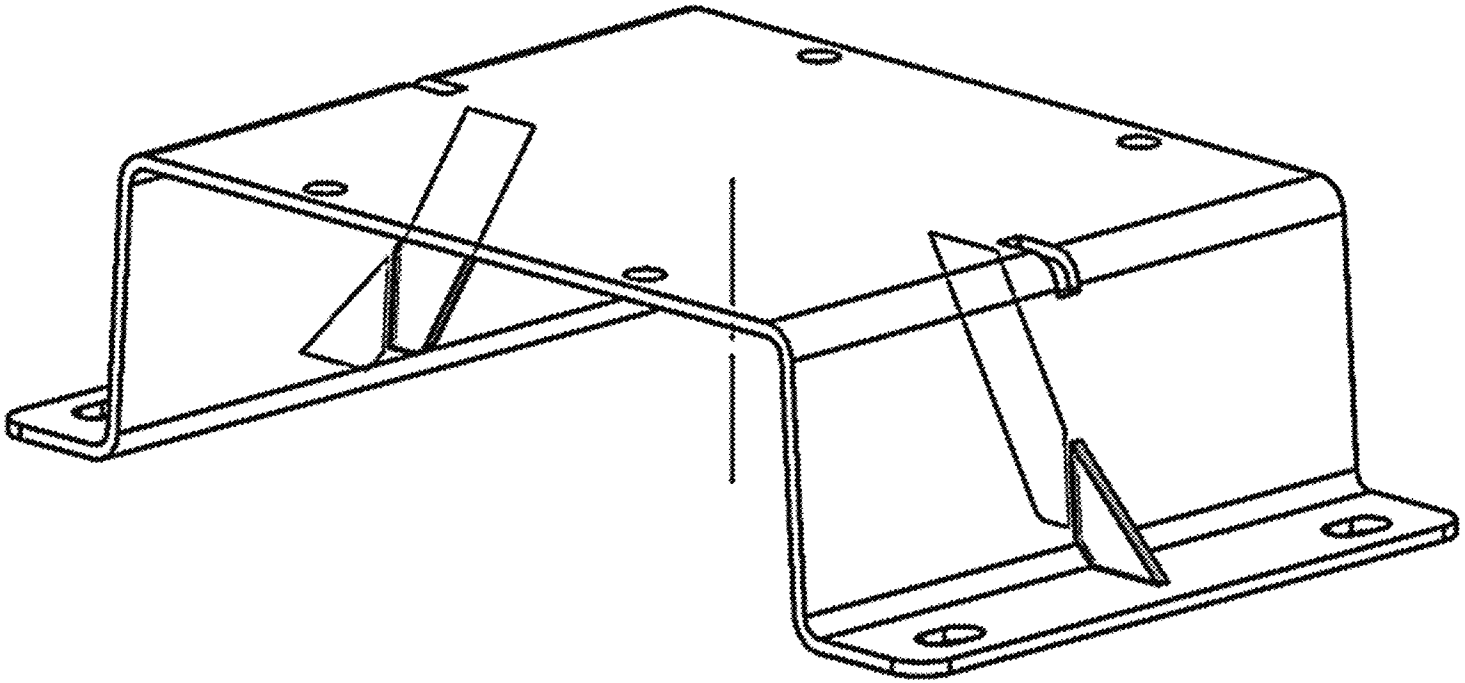
FIG. 9G is a drawing showing an isometric view of the fixed height bracket of FIG. 9A.

FIG. 9A is a drawing showing a top view of an exemplary fixed height bracket according to FIG. 1. FIG. 9B is a drawing showing a front view of the fixed height bracket of FIG. 9A. FIG. 9C is a drawing showing a flat pattern view of the fixed height bracket of FIG. 9A. FIG. 9D is a drawing showing a bend angle of the fixed height bracket of FIG. 9A. FIG. 9E is a drawing showing a side view of the fixed height bracket of FIG. 9A. FIG. 9F is a drawing showing another bend angle view of the fixed height bracket of FIG. 9A. FIG. 9G is a drawing showing an isometric view of the fixed height bracket of FIG. 9A.

Figure 10E:
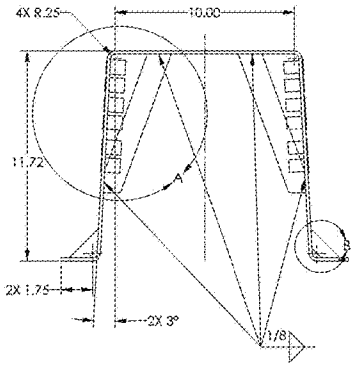
FIG. 10E is a drawing showing a front view of the bottom part bracket of FIG. 10A.
Figure 10B:
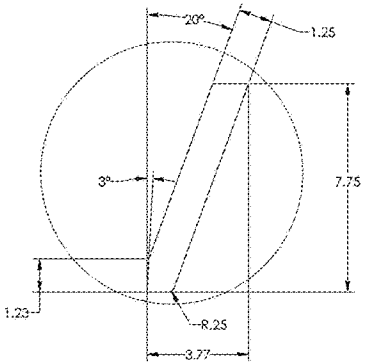
FIG. 10B is a drawing showing a bend angle of the bottom part bracket of FIG. 10A.
Figure 10D:
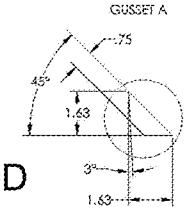
FIG. 10D is a drawing showing a gusset of the bottom part bracket of FIG. 10A.
Figure 10A:
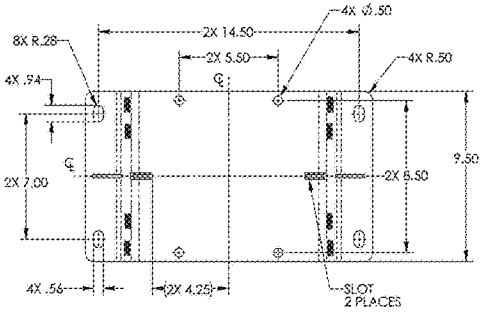
FIG. 10A is a drawing showing a top view of an exemplary bottom part bracket according to FIG. 2.
Figure 10C:
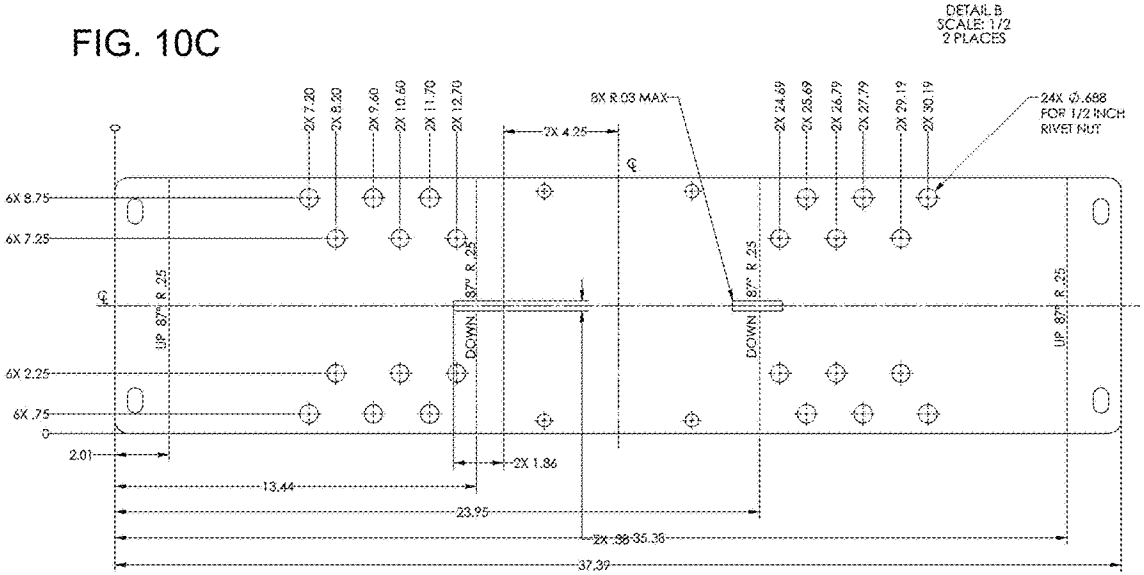
FIG. 10C is a drawing showing a flat pattern view of the bottom part bracket of FIG. 10A.
Figure 10F:
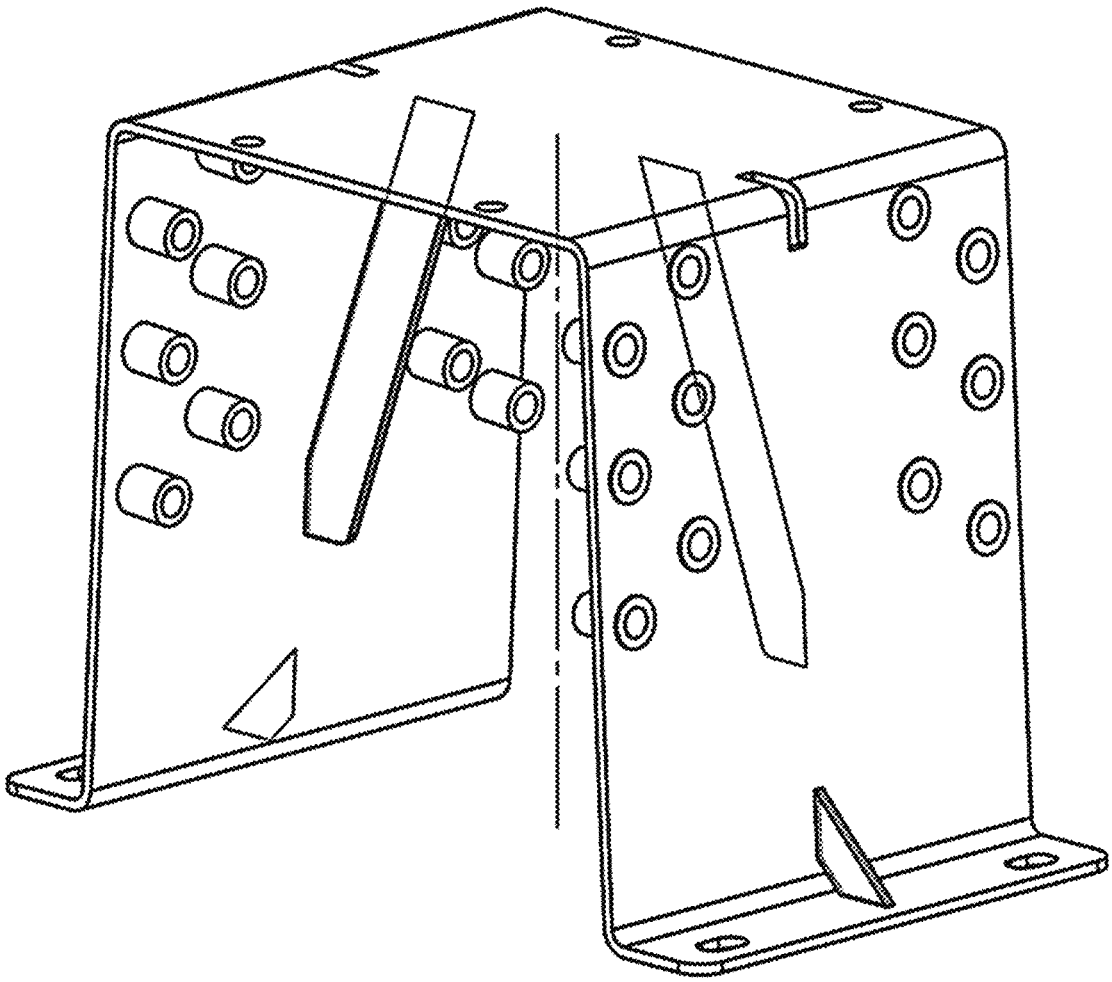
FIG. 10F is a drawing showing an isometric view of the bottom part bracket of FIG. 10A.

FIG. 10A is a drawing showing a top view of an exemplary bottom part bracket according to FIG. 2. FIG. 10B is a drawing showing a bend angle of the bottom part bracket of FIG. 10A. FIG. 10C is a drawing showing a flat pattern view of the bottom part bracket of FIG. 10A. FIG. 10D is a drawing showing a gusset of the bottom part bracket of FIG. 10A. FIG. 10E is a drawing showing a front view of the bottom part bracket of FIG. 10A. FIG. 10F is a drawing showing an isometric view of the bottom part bracket of FIG. 10A.

Figure 11C:
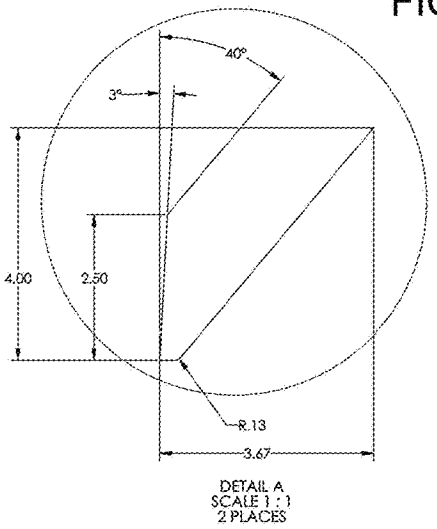
FIG. 11C is a drawing showing an angle detail of the bottom part bracket of FIG. 11A.
Figure 11A:
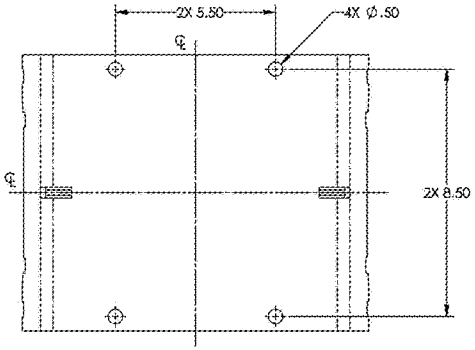
FIG. 11A is a drawing showing a top view of an exemplary top part bracket according to FIG. 3.
Figure 11D:
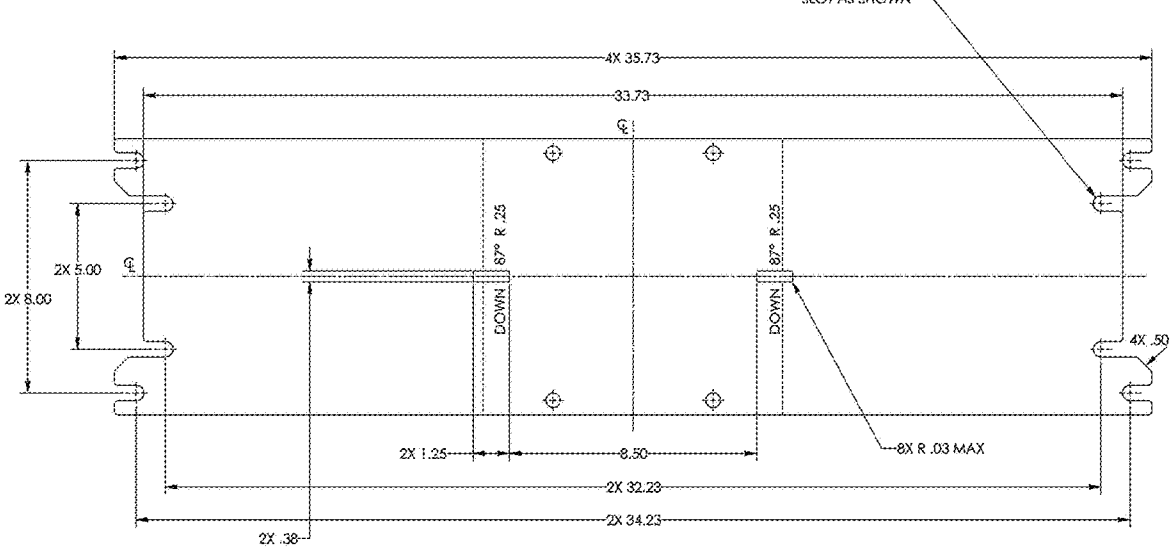
FIG. 11D is a drawing showing a flat pattern view of the bottom part bracket of FIG. 11A.
Figure 11B:
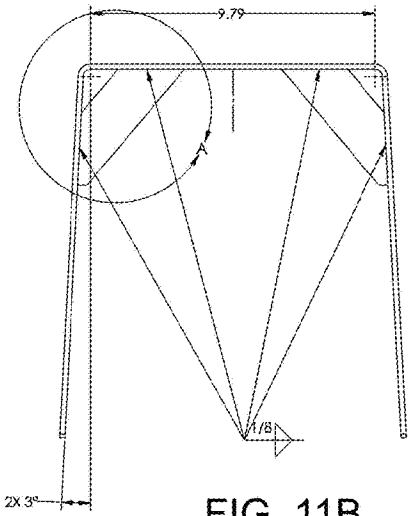
FIG. 11B is a drawing showing a front view of the bottom part bracket of FIG. 11A.
Figure 11E:
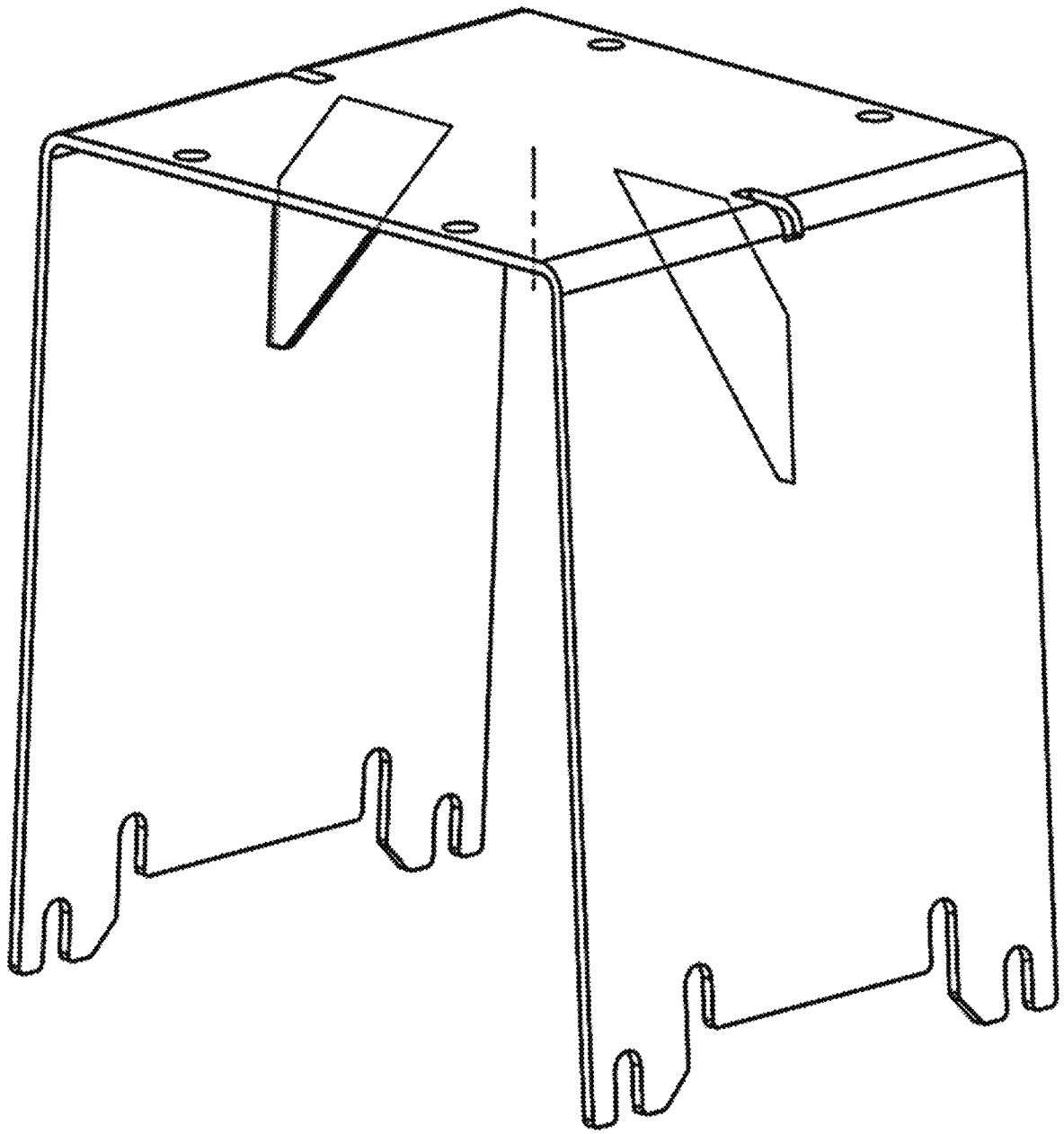
FIG. 11E is a drawing showing an isometric view of the bottom part bracket of FIG. 11A.

FIG. 11A is a drawing showing a top view of an exemplary top part bracket according to FIG. 3. FIG. 11B is a drawing showing a front view of the bottom part bracket of FIG. 11A. FIG. 11C is a drawing showing an angle detail of the bottom part bracket of FIG. 11A. FIG. 11D is a drawing showing a flat pattern view of the bottom part bracket of FIG. 11A. FIG. 11E is a drawing showing an isometric view of the bottom part bracket of FIG. 11A.

The combinations of fixed height and adjustable two-part brackets described hereinabove are but one approach to mount a heat exchanger with top connected pipes so that for various height units, the top pipe connections or couplings are at about the same height above the bottom of the heat exchanger cabinet and also, thus, at about the same height above the floor. Other exemplary adjustable base means include any suitable adjustable stand.

By use of adjustable stands, a number of different heat exchangers, having different vertical heights can be mounted in a common cabinet structure, such as, for example, a universal cabinet. The only difference when mounting the various types and capacity heat exchangers is the height of the adjustable stand which supports the base of the heat exchanger within the cabinet at varying height above the bottom of the cabinet. However, the top of the various sized heat exchangers is mounted at substantially the same location in or at the top of the universal heat exchanger cabinet.

Figure 12A:
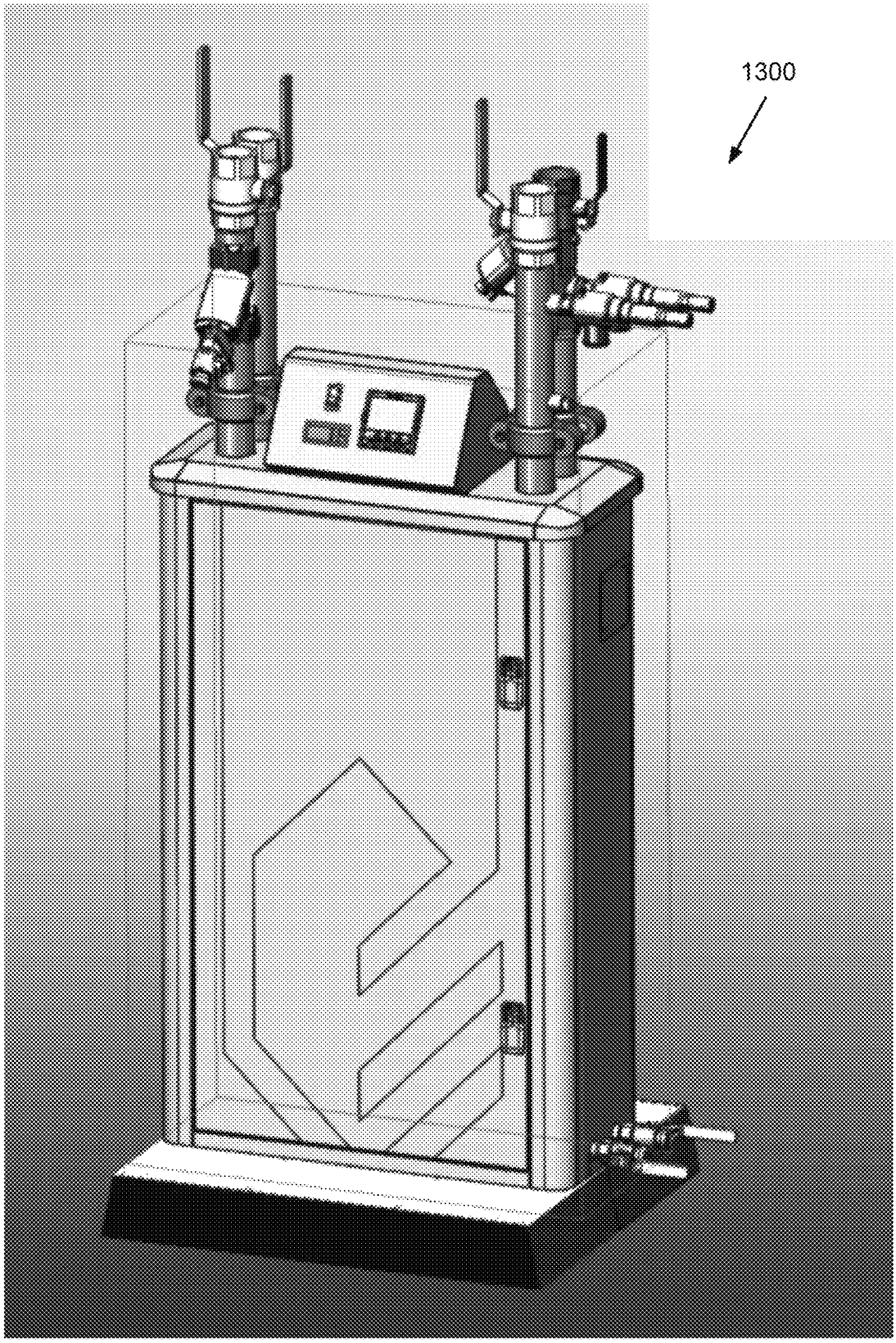
FIG. 12A is a drawing showing an exemplary universal cabinet according the Application.
Figure 12B:
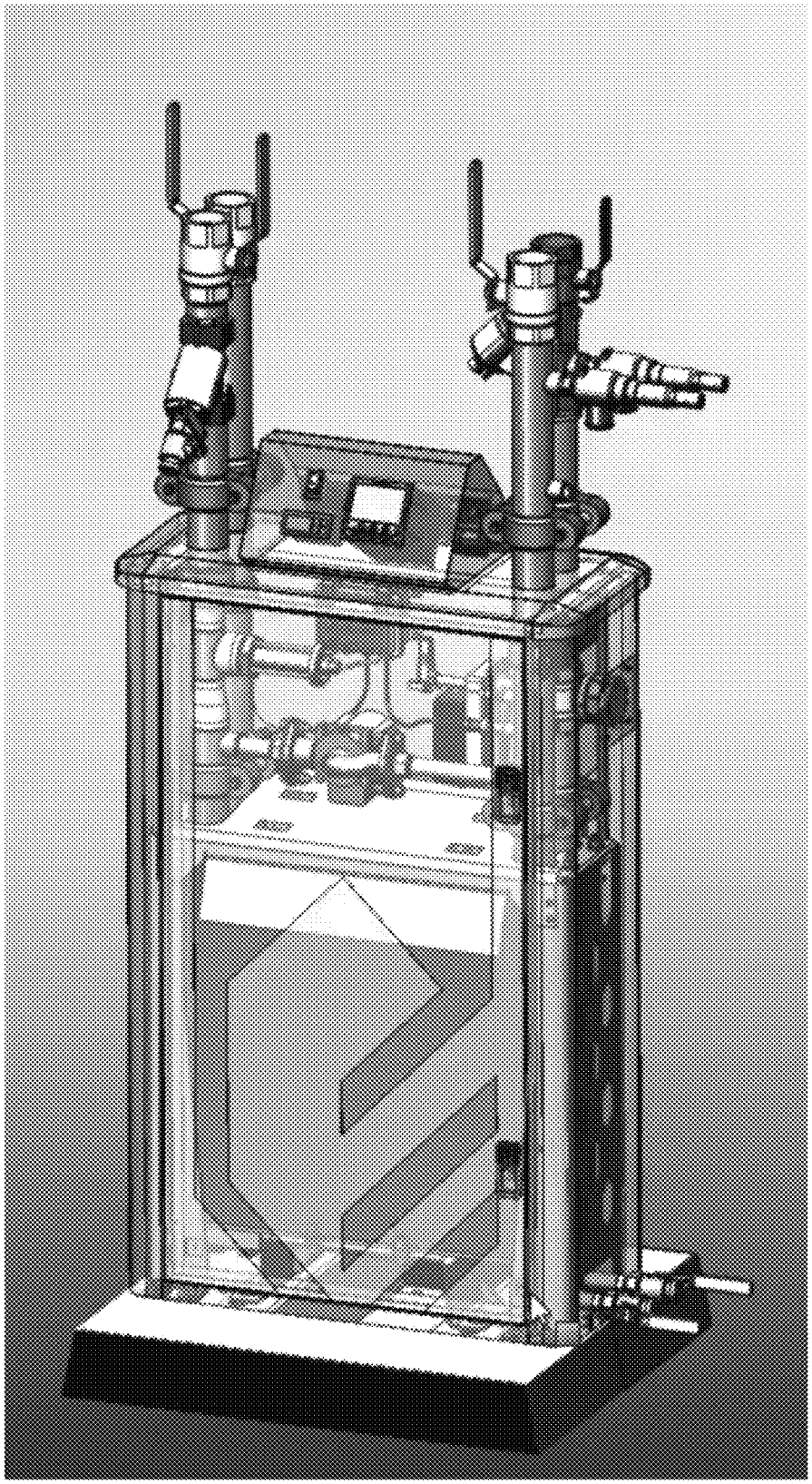
FIG. 12B is a drawing showing interior detail of the universal cabinet of FIG. 12A.
Figure 12C:
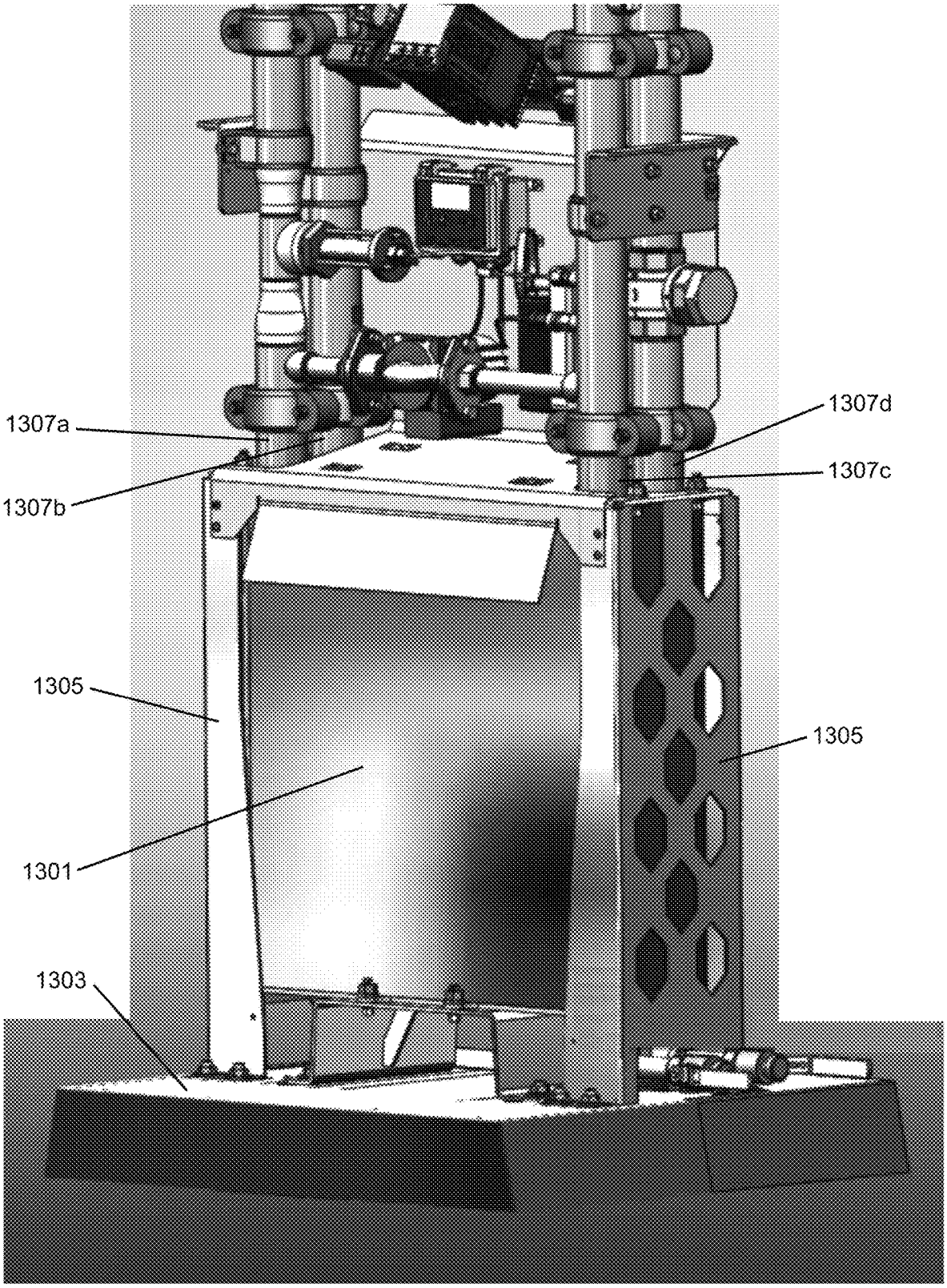
FIG. 12C is a drawing showing the interior components with the cabinet of FIG. 12A removed.

FIG. 12A is a drawing showing an exemplary universal cabinet according the Application. FIG. 12B is a drawing showing interior detail of the universal cabinet of FIG. 12A. FIG. 12C is a drawing showing the interior components with the cabinet of FIG. 12A removed.

Figure 13:
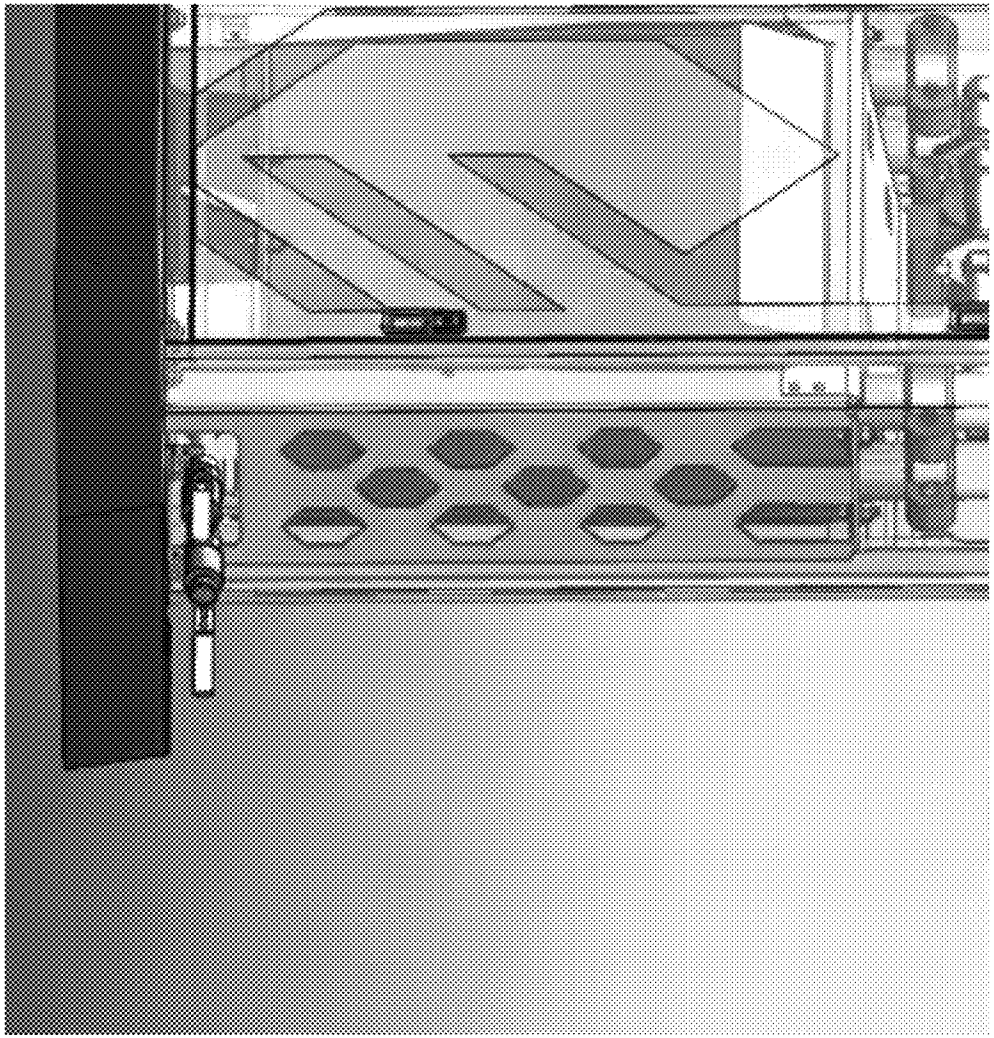
FIG. 13 shows a drawing of exemplary drain pipes connections near the base of universal cabinet of the style of FIG. 12A.

Drain pipes—While the adjustable base brackets allow for a universal cabinet for various types and heights of heat exchangers, there can be other piped connections at other locations. FIG. 13 shows a drawing of exemplary drain pipes connections near the base of universal cabinet of the style of FIG. 12A.

For example, there can be drain pipes, condensation pipes, etc. Where those pipes are fluidly coupled to fixed components at the top of the universal cabinet, they can be plumbed along the side of the universal cabinet and out near the bottom. Such pipes can have a similar length for the various types of heat exchangers. However, where a fluid connection is made to a side or near the bottom of the differing length heat exchangers, there can be any suitable pipe means of fluidly coupling such a side mounted port or base port to the side and bottom connections. For example, there can be a number of different length pipes, any suitable variable length pipe including sliding and telescoping pipes, coiled, wound, accordioned, hoses or pipes, rigid, semi-rigid, or flexible pipes or hoses, etc.

Heat Shield—There can be significant radiant heat from a heat exchanger. Such heat, including both radiative and heated air can pose a risk to controls, valves, and other instrumentation which may be present and typically mounted above the top of the heat exchanger. It was realized that the risk to controls, sensors, actuators, pumps, instrumentation, etc. mounted above the heat exchanger from overheating has been mitigated by incorporation of a heat shield. The heat shield blocks both direct radiative heating of components mounted above the shield over the heat exchanger, as well as directs any heated air up and out of the back of the cabinet (with louvers for example)

Figure 14A:
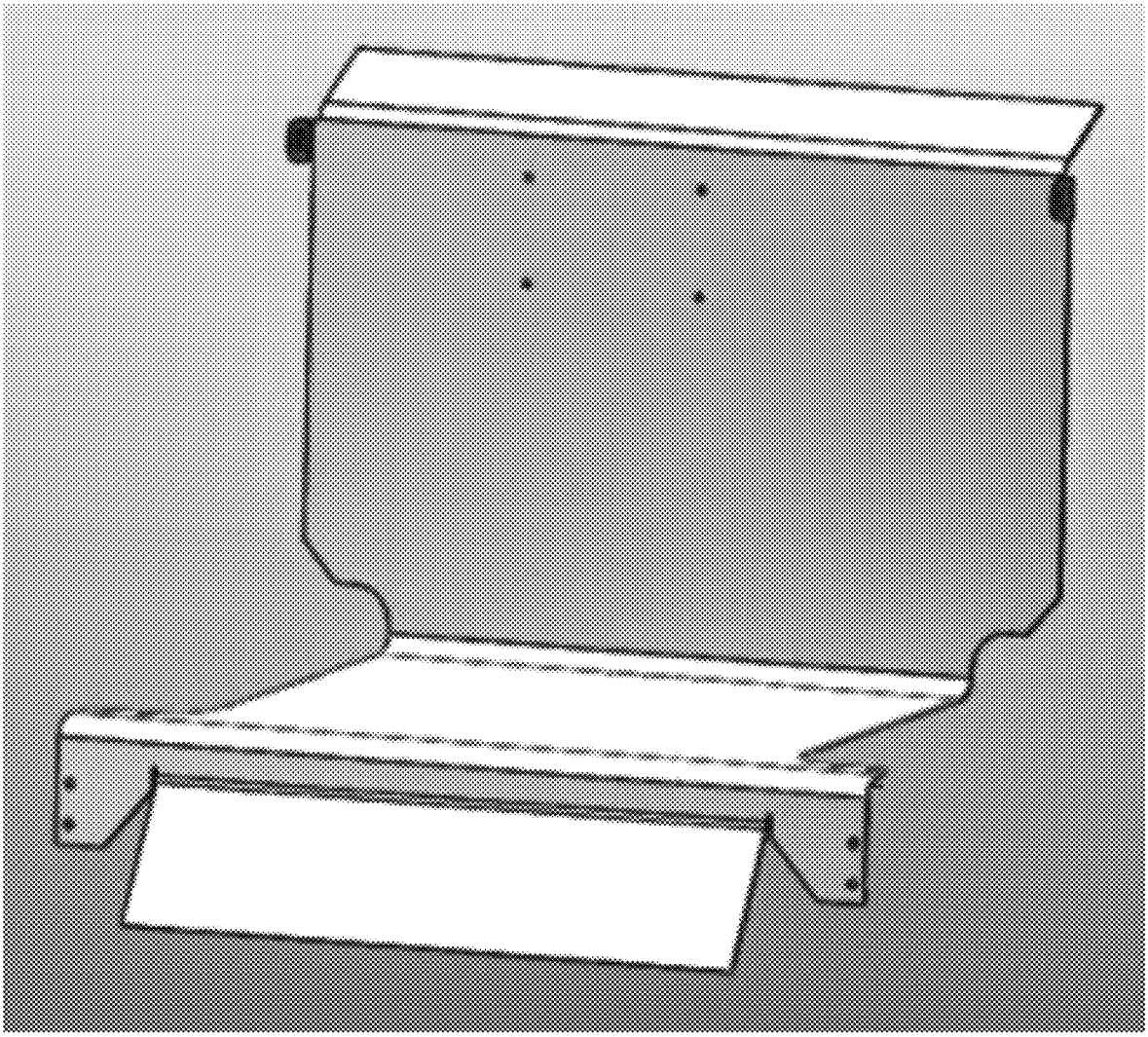
FIG. 14A is a drawing showing an exemplary heat shield.
Figure 14B:
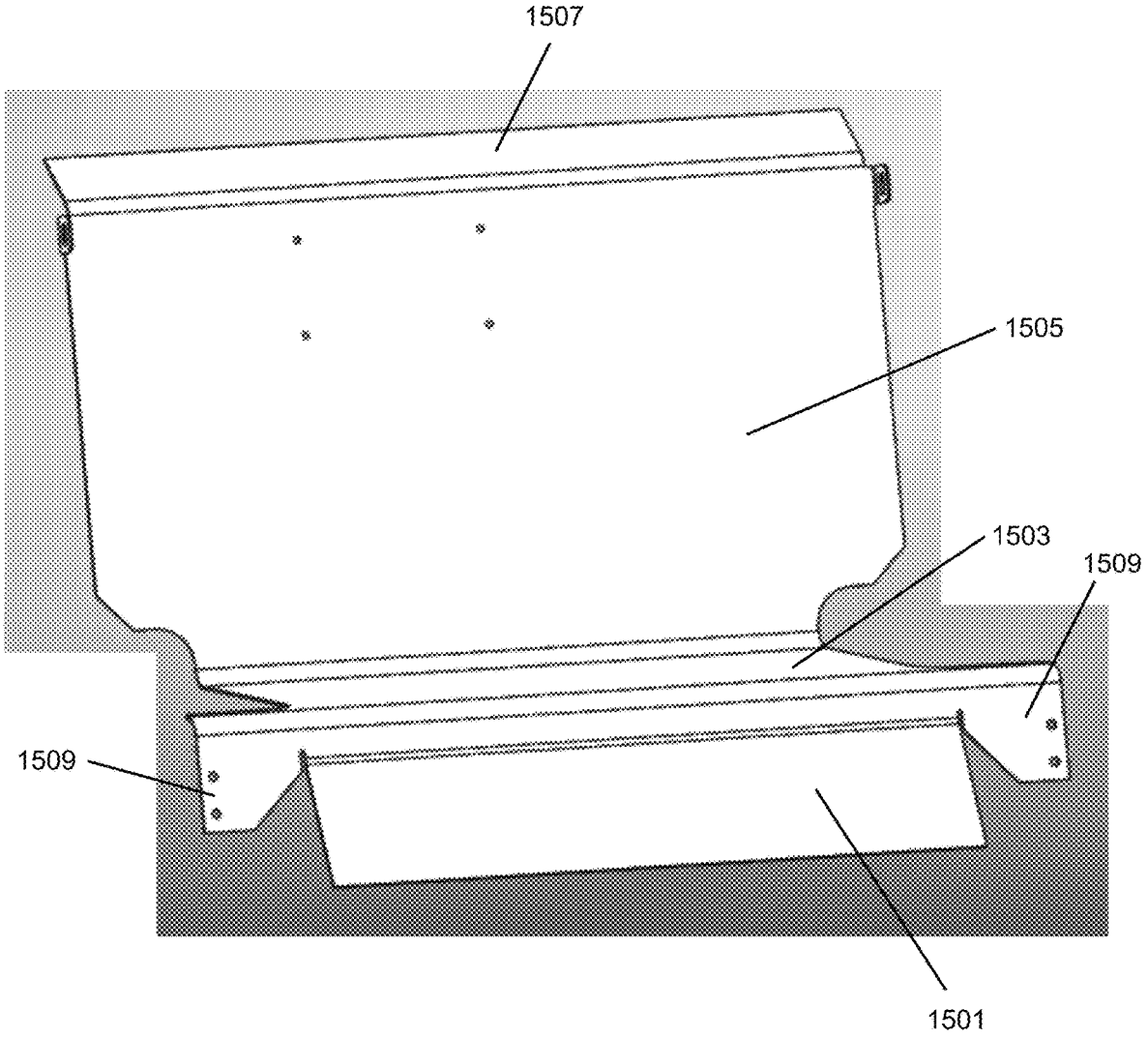
FIG. 14B is a drawing showing another view of the heat shield of FIG. 14A.
Figure 14C:
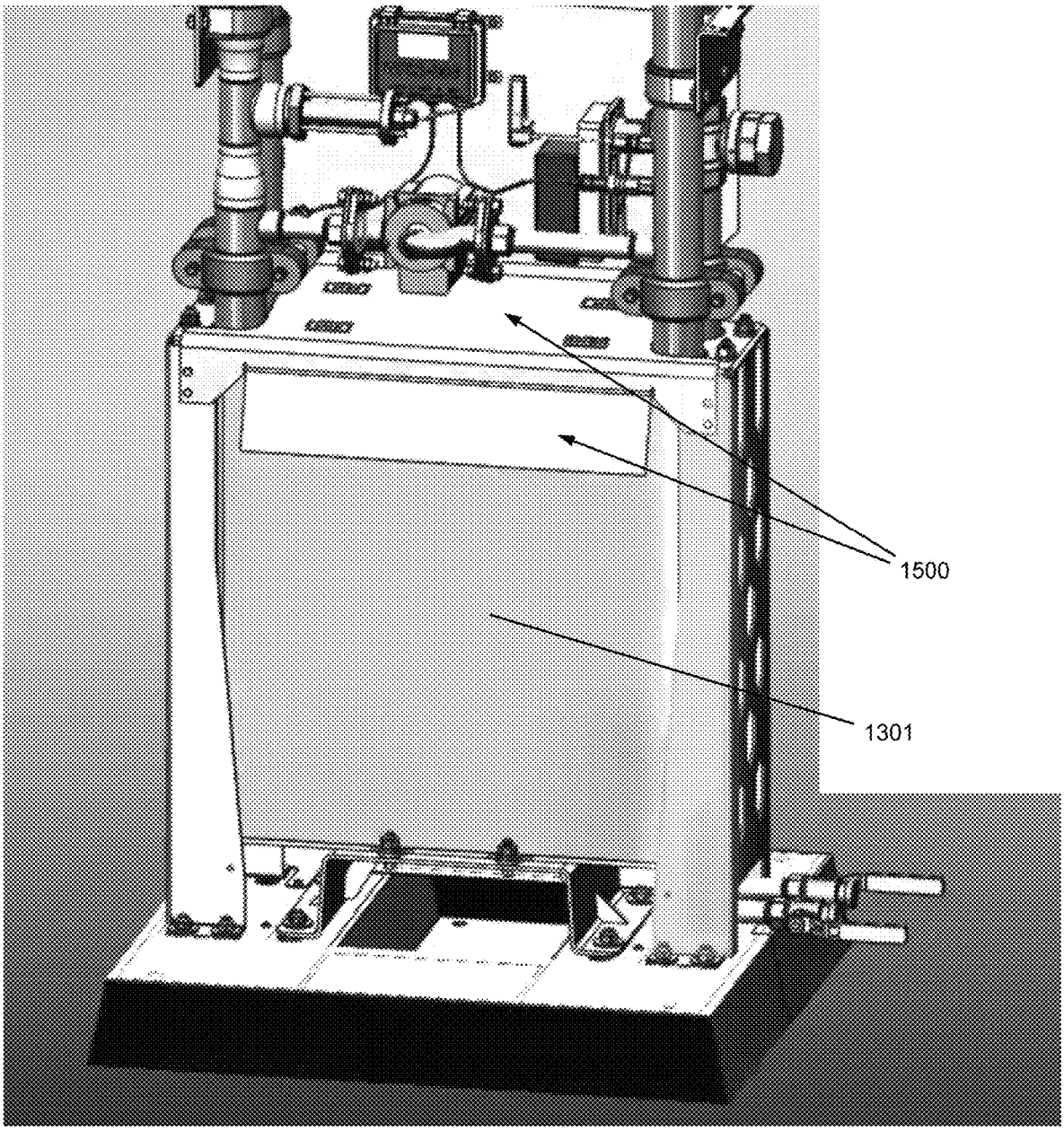
FIG. 14C is a drawing showing a universal cabinet with a heat shield mounted above the heat exchanger and between the heat exchanger and any controls, sensors, actuators, pumps, instrumentation, etc. mounted above the heat exchanger.

FIG. 14A is a drawing showing an exemplary heat shield 1500. The front lower portion helps to reduce radiant heat up and to the front, while the front overhang helps to gather and channel heated air rising from the front of the heat exchanger. The flat portion further ducts heated air to the rear chimney portion which ducts heated air out the top back of the universal cabinet. FIG. 14B is a drawing showing another view of the heat shield of FIG. 14A. FIG. 14C is a drawing showing a universal cabinet with a heat shield 1500 mounted above the heat exchanger and between the heat exchanger and any controls, sensors, actuators, pumps, instrumentation, etc. mounted above the heat exchanger.

A heat shield (e.g., FIG. 14B) for a heat exchanger cabinet includes a forward lower skirt 1501. An about flat or low angle surface front to rear 1503 extends above and from the forward lower skirt 1501. An about vertical chimney sheet 1505 extends above and from the about flat or low angle surface front to rear 1503. An upper rear discharge fin 1507 extends above and from the about vertical chimney sheet 1505.

Vertical pipe mounts—As described hereinabove, one of the aspects of the universal cabinet for a heat exchanger according to the Application is that the main fluid pipe connections are made at the top of the heat exchanger. The main connections include heated fluid in, heated fluid out, (for example from a boiler) cold water in, and cold water out (domestic heated water). The heated fluid is typically water. It is convenient, at least for a providing instrumentation, controls, sensors, pumps, valves, etc. to extending the main pipes upwards in a vertical direction for some distance, typically about one to four feet. Because the four main pipes are relatively integral to the heat exchanger mounted in a universal cabinet, it was realized that the pipes themselves can be used to support parts of the universal cabinet.

Figure 15A:
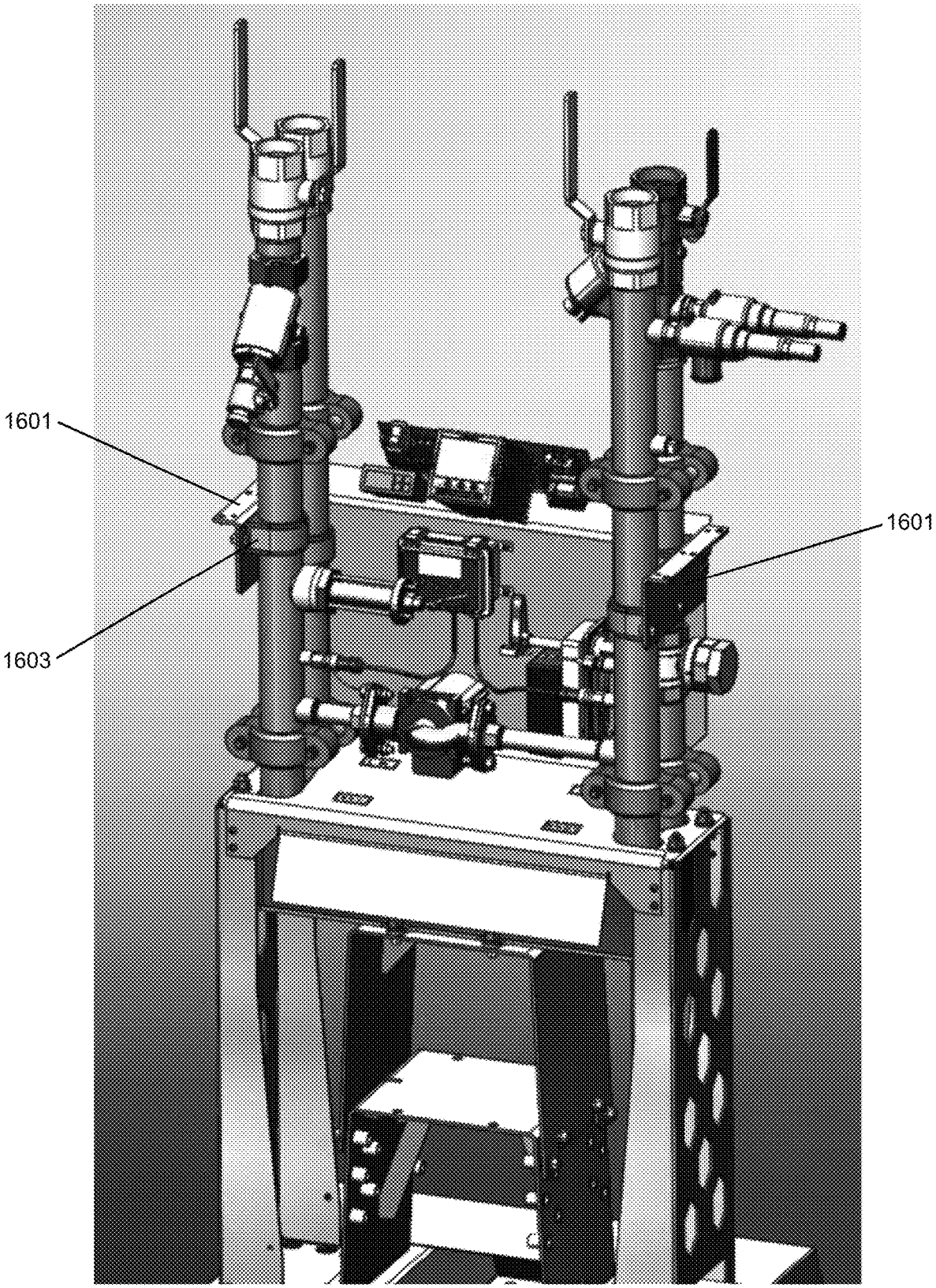
FIG. 15A is a drawing showing an exemplary cabinet side pipe bracket 1601 and pipe clamp 1603.
Figure 15B:
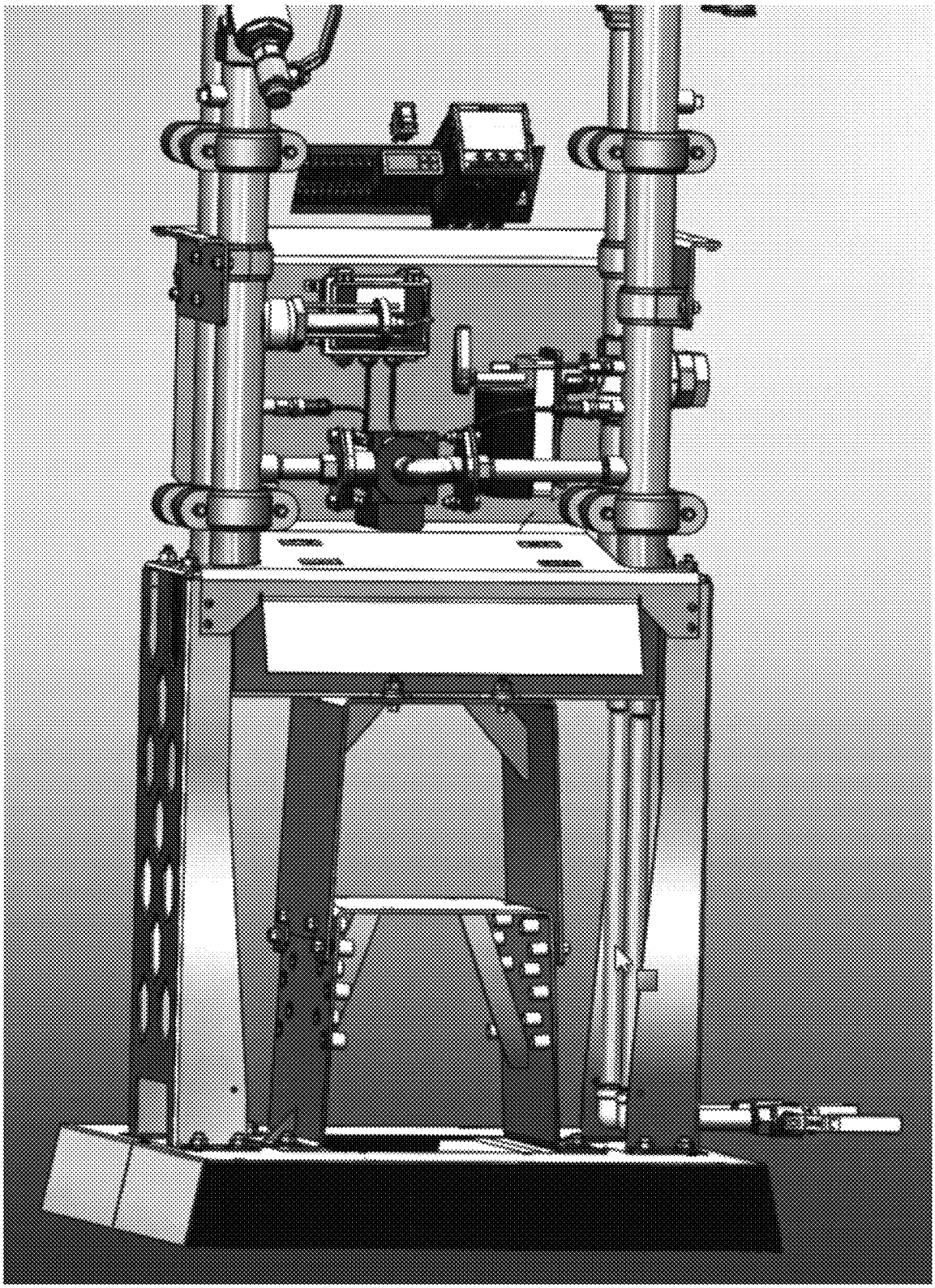
FIG. 15B is a drawing showing another view of the exemplary cabinet side pipe bracket and pipe clamp of FIG. 15A.
Figure 15C:
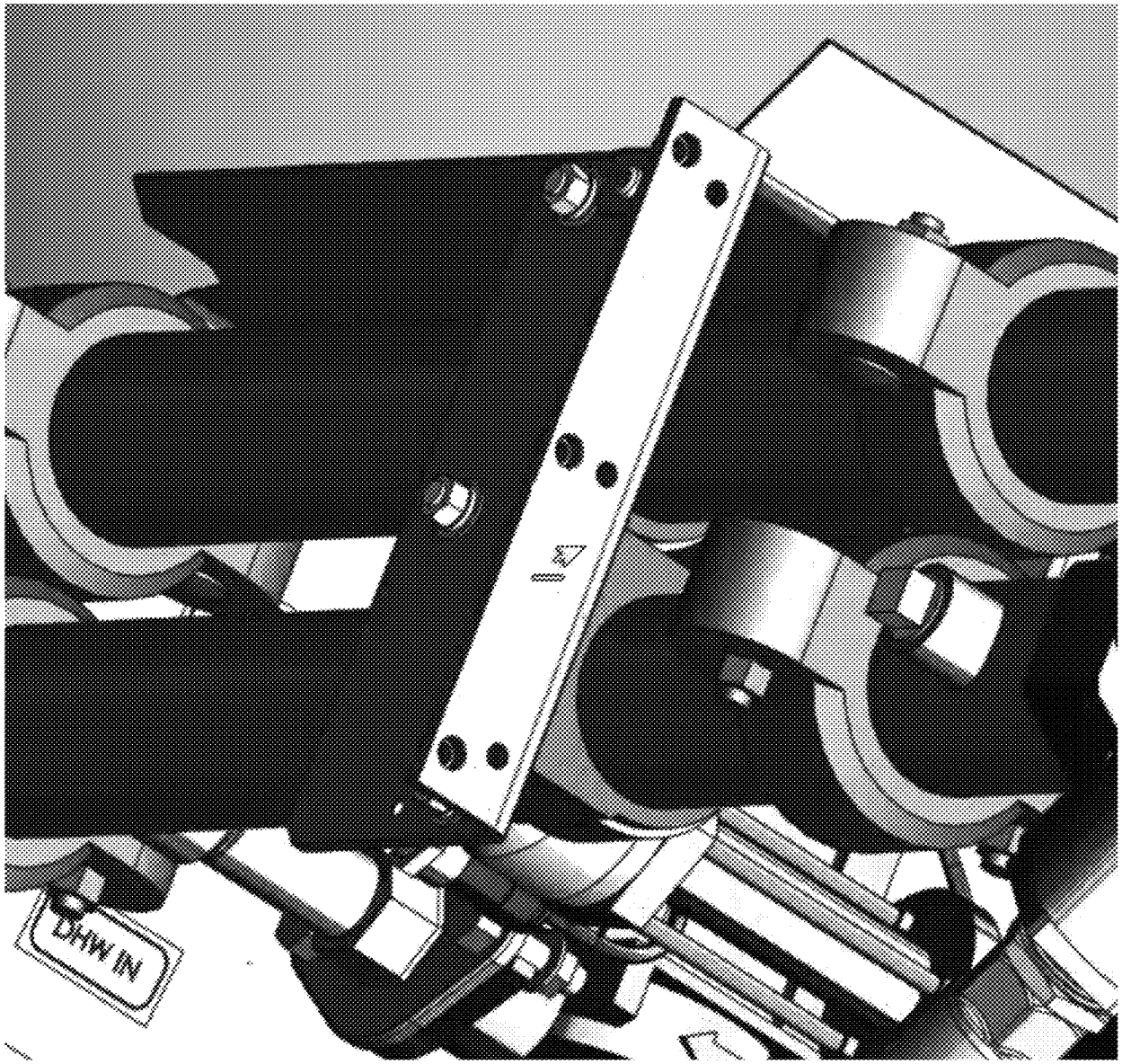
FIG. 15C is a drawing showing an elevated view of the exemplary cabinet side pipe bracket of FIG. 15A.
Figure 15D:
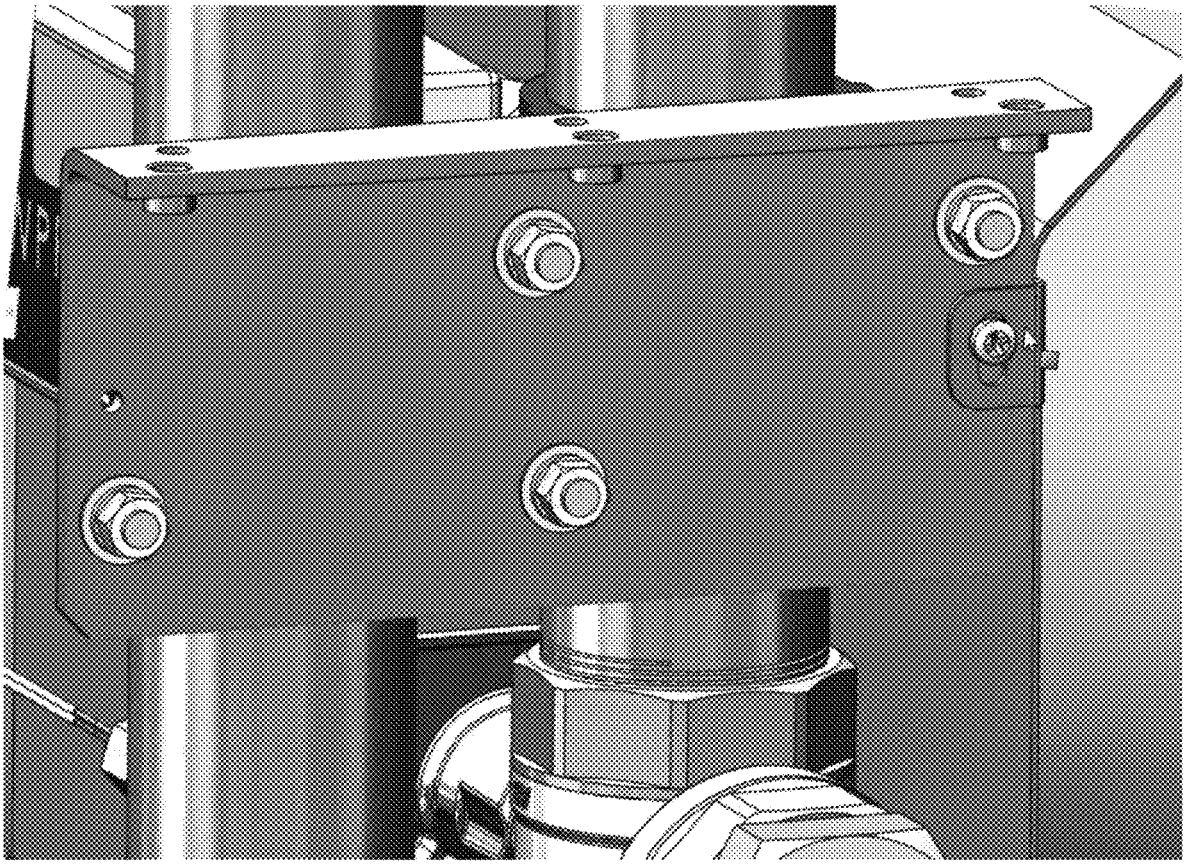
FIG. 15D is a drawing showing a close up view of the exemplary cabinet side pipe bracket of FIG. 15A.

FIG. 15A is a drawing showing an exemplary cabinet side pipe bracket 1601 and pipe clamp 1603. FIG. 15B is a drawing showing another view of the exemplary cabinet side pipe bracket and pipe clamp of FIG. 15A. FIG. 15C is a drawing showing an elevated view of the exemplary cabinet side pipe bracket of FIG. 15A. FIG. 15D is a drawing showing a close up view of the exemplary cabinet side pipe bracket of FIG. 15A. The sides of the universal cabinet can be mounted in part by use of the top holes of each of the cabinet side pipe brackets 1601. Any suitable hole, metal screw, machine screws, etc. can be used to screw or bolt the cabinet, or cabinet panels to the cabinet side pipe bracket 1601. For example, FIG. 15D shows a threaded insert to provide a threaded hole to receive machine screws to attach the sides of the cabinet cover to the cabinet assembly at least in part by affixing the cover by machine screws to the cabinet side pipe brackets 1601.

Figure 16:
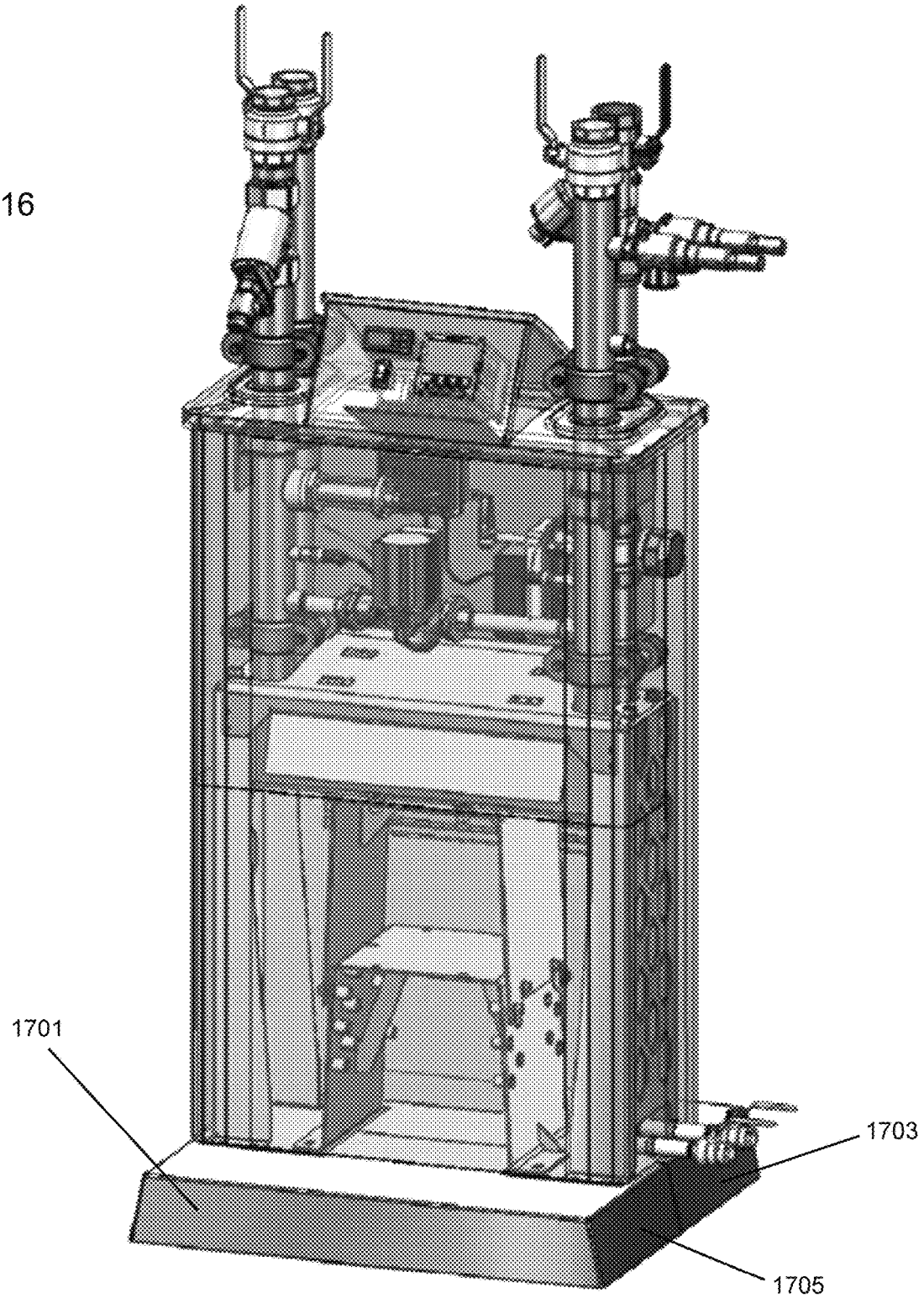
FIG. 16 is a drawing showing an exemplary skirt with a front skirt and side skirt parts.

Bottom Skirt—As can be seen, for example, in FIG. 7, typically a heat exchanger is mounted on any suitable type of pallet, such as a corrugated metal pallet. The pallet typically becomes a permanent portion of the cabinet, such as a universal cabinet, often serving as a bottom structural of the cabinet. Note, this bottom, typically metal pallet, is different from, and unrelated to a protective shipping pallet, typically build from wood. The bottom cabinet pallet typically includes channels, such as shown in FIG. 7. It was realized that both for aesthetic reasons, as well as practical use considerations, such as discouraging small animals from nesting in the cabinet bottom pallet, it is desirable to cover all around the base with a skirt made of any suitable material, typically a metal or plastic sheet. FIG. 16 is a drawing showing an exemplary skirt with a front skirt 1701, and side skirt parts 1705, 1703. Some cabinet lower pallets (e.g., FIG. 7) may provide two sides of the skirt by the metal pattern of the lower pallet itself (e.g. FIG. 7 shows slanted walls on either side of the pallet as part of the FIG. 7 corrugated structure).

Figure 17:
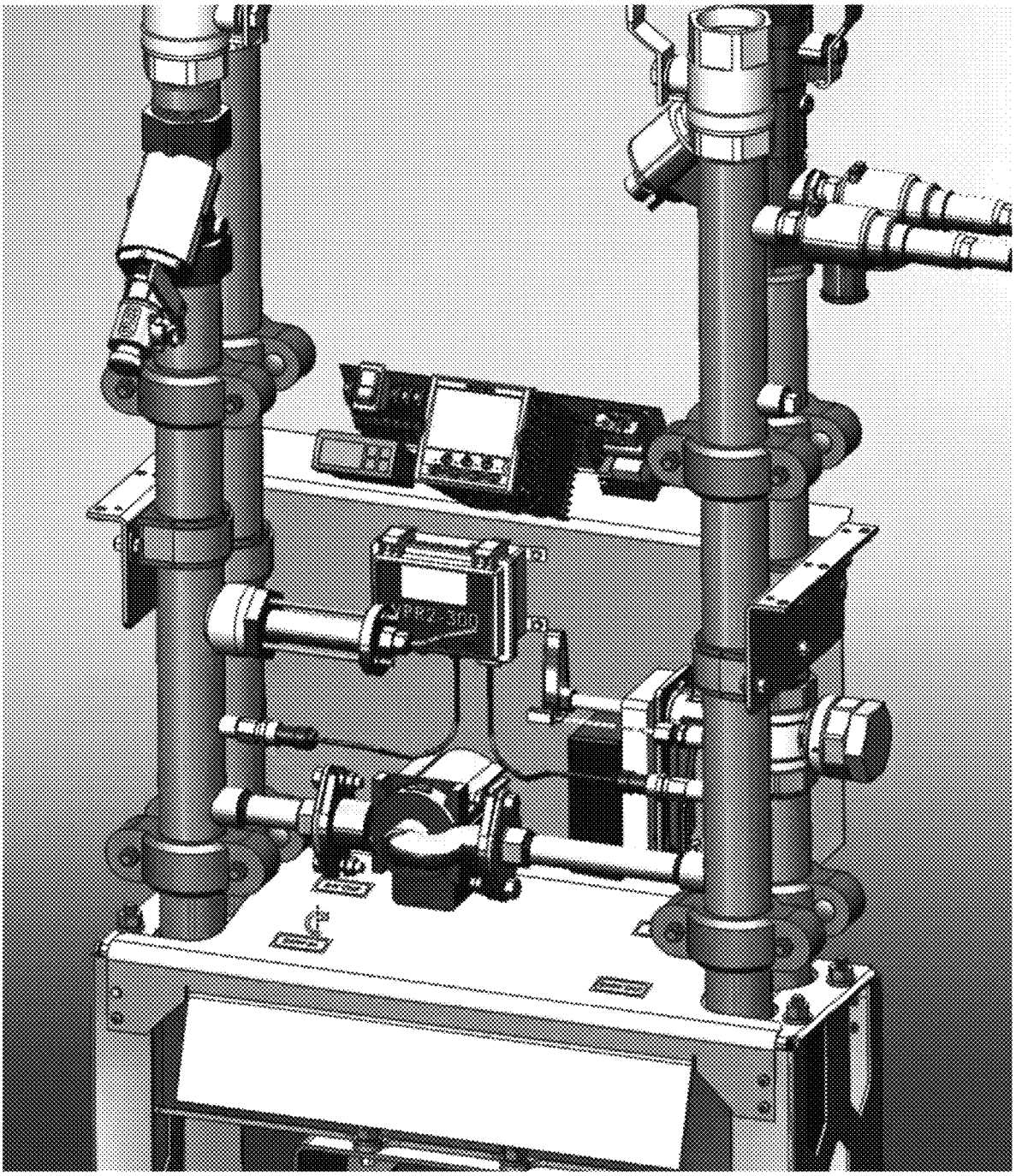
FIG. 17 is a drawing showing exemplary controls, pumps, valves, actuators, and other instrumentation mounted above a heat shield and between side panels affixed by cabinet side pipe brackets.

FIG. 17 is a drawing showing exemplary controls, pumps, valves, actuators, and other instrumentation mounted above a heat shield 1500 and between side panels affixed by cabinet side pipe brackets 1601.

Continuously Adjustable Base Brackets—FIG. 18 to FIG. 20B are drawings of continuously adjustable base brackets with locking mechanism—The continuously adjustable telescoping brackets of FIG. 18 to FIG. 20B are different than previously described brackets with a plurality of optional or settable fixed positions corresponding to pre-located threaded holes.

Figure 18:
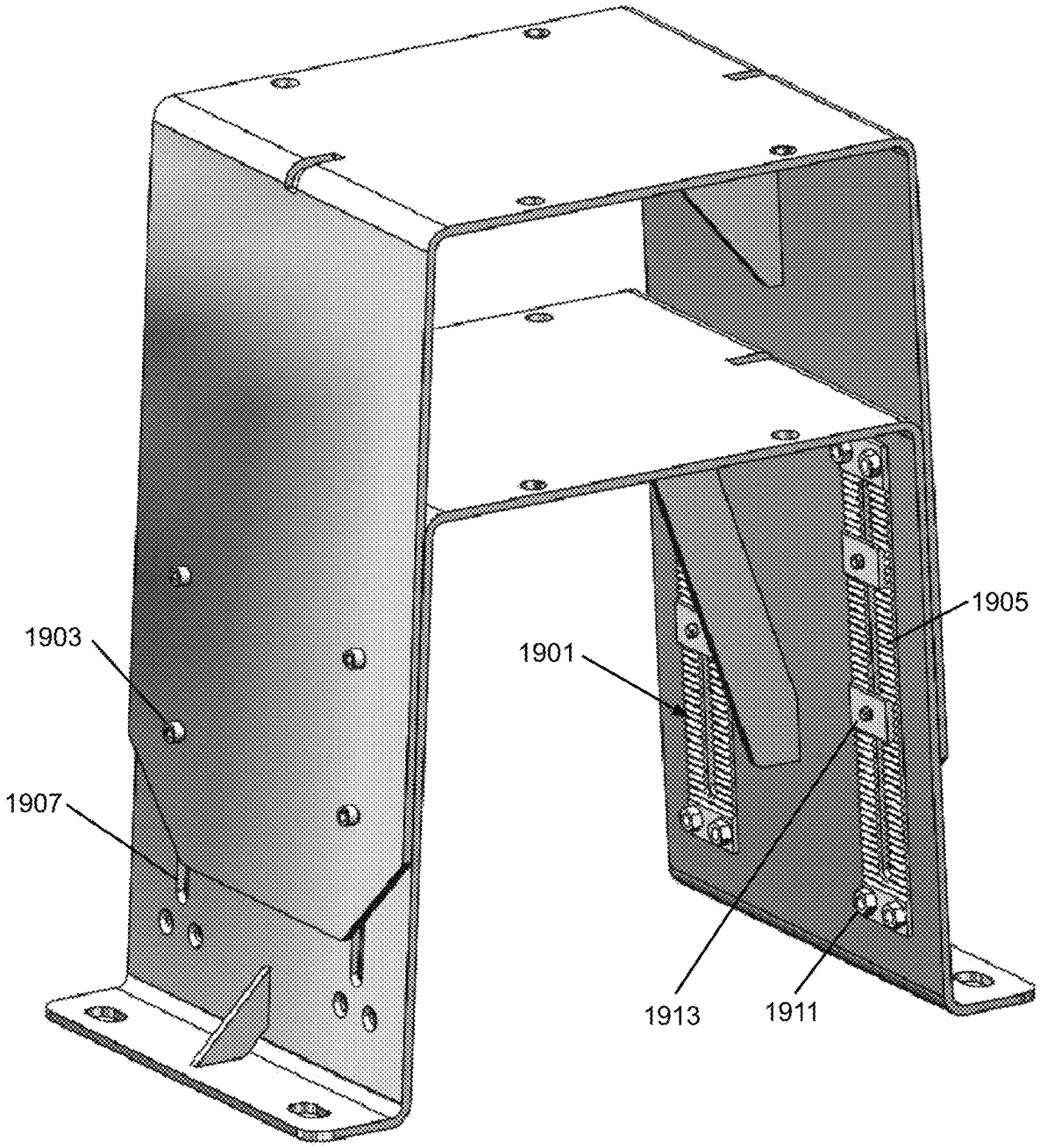
FIG. 18 shows an exemplary continuously adjustable base bracket with locking mechanism according to the Application.

FIG. 18 shows an exemplary continuously adjustable base bracket with locking mechanism according to the Application. Now, the bottom part bracket includes slots 1907 instead of preset holes or preset threaded holes. The top part bracket includes a plurality of screw or bolt holes, with exemplary machine screws or bolts 1903. By use of a fastener, such as, for example any suitable nut, the top part bracket can be affixed at any desired height above the bottom part bracket, determining the height of the two-part bracket structure.

Figure 19:
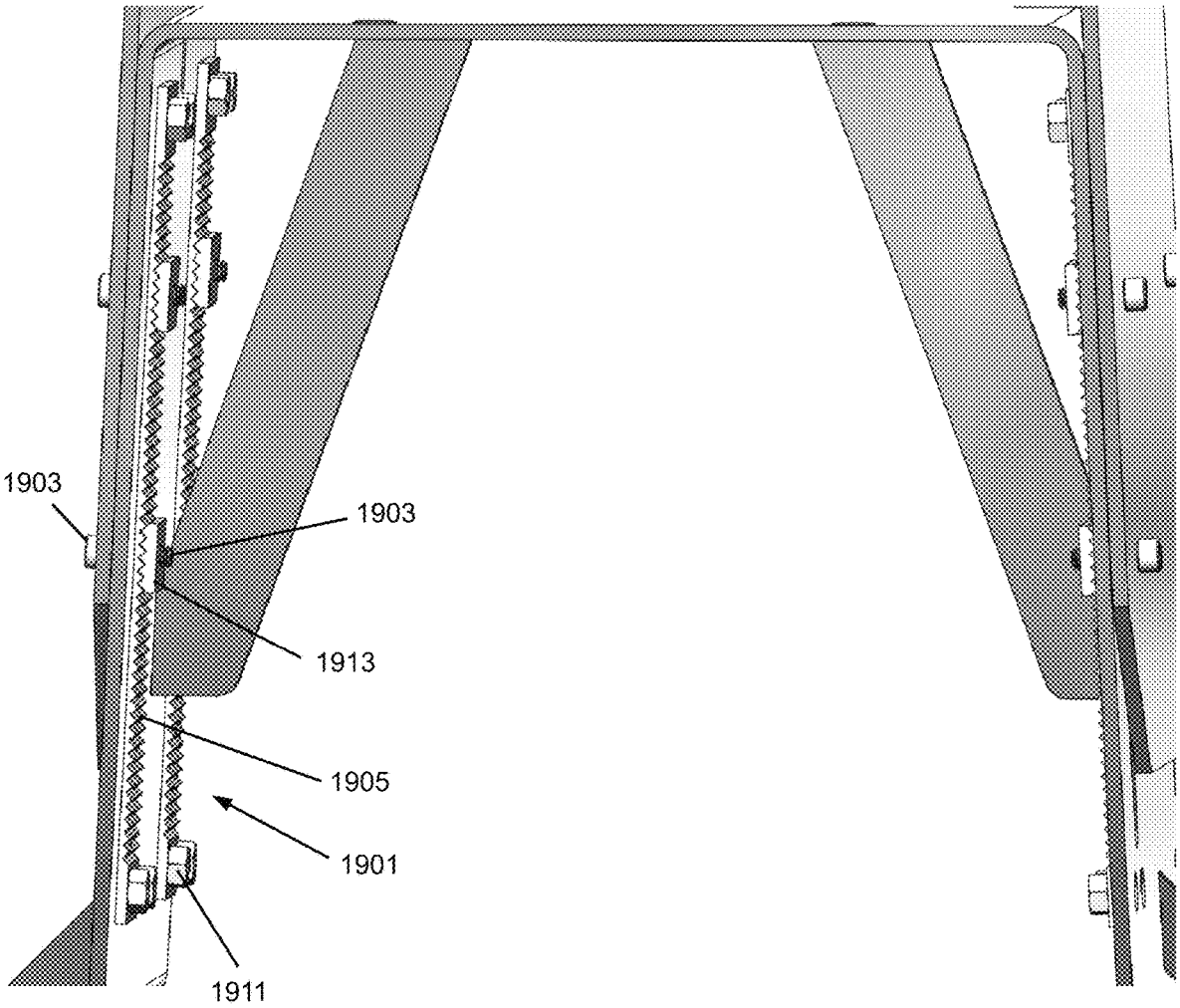
FIG. 19 is a drawing showing a side view of the continuously adjustable base bracket of FIG. 18.
Figure 20B:
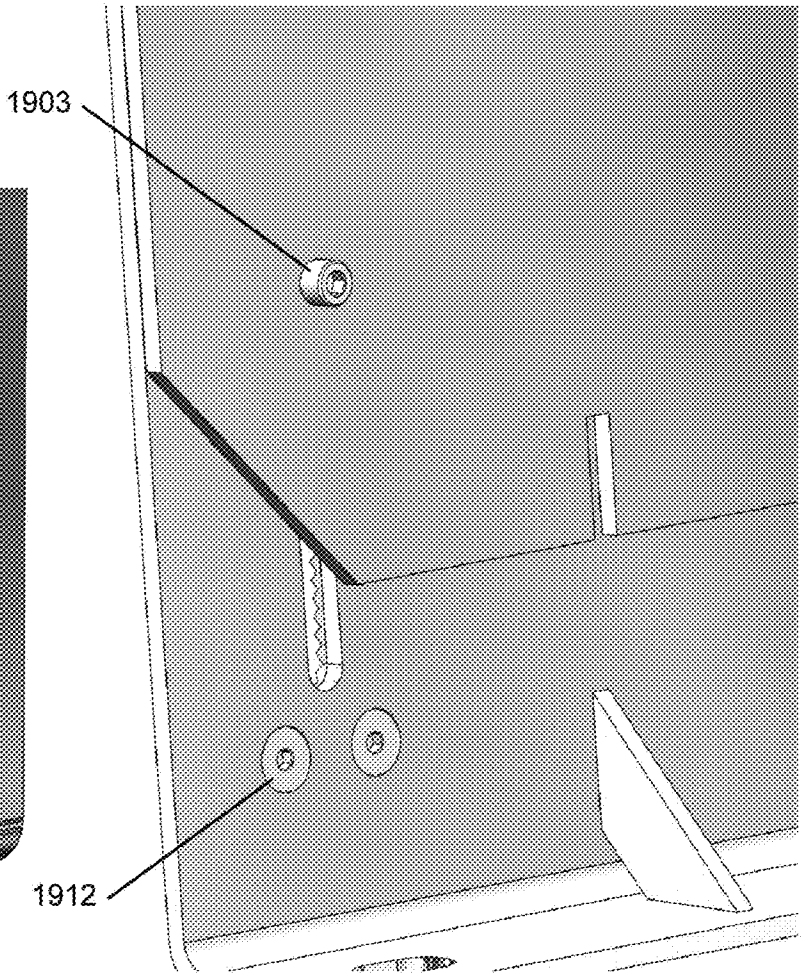
FIG. 20B is a drawing showing a more detailed outside view of the continuously adjustable base bracket of FIG. 18.
Figure 20A:
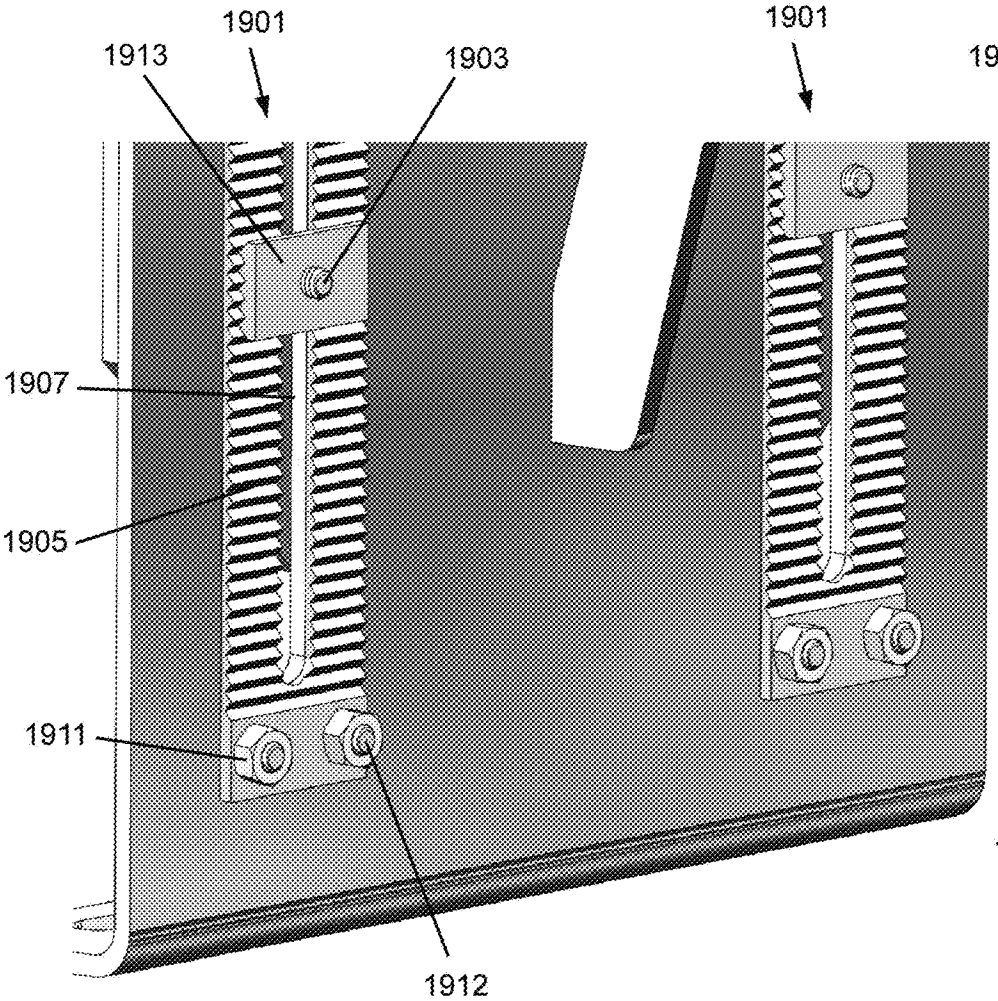
FIG. 20A is a drawing showing a more detailed inside view of the continuously adjustable base bracket of FIG. 18.

FIG. 19 is a drawing showing a side view of the continuously adjustable base bracket of FIG. 18. FIG. 20A is a drawing showing a more detailed inside view of the continuously adjustable base bracket of FIG. 18. FIG. 20B is a drawing showing a more detailed outside view of the continuously adjustable base bracket of FIG. 18.

Especially where the two-part continuously adjustable bracket is intended to support relatively heavy loads, such as, a relatively heavy heat exchanger, the two-part adjustable bracket can be further stabilized by a locking mechanism assembly 1901. For example, there can be a longitudinal slotted element of locking mechanism assembly 1901 with teeth 1905 as shown in FIG. 18 to FIG. 20B, such as where the nuts 1913 have corresponding meshing teeth. In the case of a two-part continuously adjustable bracket with teeth, the resolution of adjustment is still substantially continuous as defined by the vertical spacing of the teeth.

The longitudinal slotted elements of locking mechanism assembly 1901 can be further secured as shown to the inside of the bottom part of the two-part bracket about one or more slots. The exemplary longitudinal slotted elements of FIG. 18 to FIG. 20B are mechanically coupled to the inside of the bottom part brackets by four corner screws or bolts 1912 with exemplary hex nuts 1911. However, the longitudinal slotted elements can also or alternatively be affixed to the bottom part brackets by any suitable glue, epoxy, adhesive, welding, bonding, mechanical fasteners, etc. Note that while still a relatively continuous adjustment compared to a limited number of fixed height holes, in the context of longitudinal slotted elements with teeth, the increment of continuous adjustment corresponds to the spacing of the teeth, because once locked the teeth of nuts slide into and mate with the corresponding teeth 1905 of the longitudinal slotted element of the locking mechanism assemblies 1901.

Materials—Any of the heat exchanger base brackets or bracket parts can be manufactured from any suitable material, typically steel, galvanized steel, treated steel, steel alloys, stainless steel and any combinations thereof. Clamps and other supports can be made from any suitable material including plastics or any suitable metals.

Manufacture—Any of the heat exchanger base brackets or bracket parts can be manufactured by any suitable methods including cutting (abrasive, toothed blades, water jet, laser, etc.), stamping, etc. Bends can be formed by any suitable bending process. Holes can be provided as threaded holes by threading, or any suitable threaded insert, including riveted threaded inserts, press fit threaded inserts, combinations thereof, etc.

In summary, and with regard to the exemplary drawings, a heat exchanger cabinet 1300 includes a base pallet 1303. A pair of heat exchanger side support brackets 1305 support a vertically mounted heat exchanger 1301. A heat exchanger base bracket 101 of a selected fixed height (FIG. 1, FIG. 2) or an adjustable height (FIG. 5) provides a support of a bottom of a heat exchanger 1301. When the heat exchanger 1301 selected from a plurality of different heat exchangers having a range of different heights is mounted within the heat exchanger cabinet, regardless of the heat exchanger height within the range of different heights (FIG. 4A to FIG. 4E), by selection or adjustment of the heat exchanger base bracket, the heat exchanger mounted thereon includes a plurality of top mounted fluid inlets and outlets (1307*a*, 1307*b*, 1307*c*, 1307*d*, disposed at about a same height above the base pallet.

The heat exchanger cabinet can further include one or more skirt portions (e.g. 1701, 1703, 1705) covering at least one side of the base pallet.

A heat exchanger base bracket set (FIG. 4A to FIG. 4E) includes at least one fixed height heat exchanger base bracket (FIG. 1, 101). At least one two-part adjustable heat exchanger base bracket (FIG. 5) includes a bottom bracket (FIG. 2) of the two-part adjustable heat exchanger base bracket having a plurality of levels of different height mounting holes (221*a-c*, 223*a-c*, 225*a-c*, and 227*a-c*). The bottom bracket 201 serves as either a standalone fixed height bracket of different height than the at least one fixed height heat exchanger base bracket, or as a bottom bracket portion of the at least one two-part adjustable heat exchanger base bracket, FIG. 5. A top bracket FIG. 3, 301, has a plurality of mounting holes or bottom slots (e.g. 321, 323, 325, and 327) at or near a lower edge of each side of the top bracket 301. The combination of the at least one fixed height heat exchanger base bracket, the bottom bracket as a standalone fixed height bracket, and the at least one two-part adjustable heat exchanger base bracket with a plurality of levels yields a range of possible heat exchanger base heights of two plus a number of adjustable levels of the at least one two-part adjustable heat exchanger base bracket (e.g. the five height settings from 3 bracket parts shown in FIG. 4A to FIG. 4E).

A stackable heat exchanger base bracket (FIG. 1, FIG. 2, and FIG. 3) includes a pair of stackable heat exchanger base bracket sides (119, 219, 319). A top surface 111 includes a stacking slot (103, 203, 303) at either side of the top surface. Each diagonal brace (105, 205, 305) of the pair of diagonal braces is mechanically coupled from a lower inside surface of the top surface 111, to an interior wall of a lower portion of each side (119, 219, 319), or extends through a slot (116, 216, 316) in the interior wall of the lower portion of each side, to a horizontal mounting flange 107 extending horizontally outward from a bottom of each side (119, 219). On stacking or nesting the stackable heat exchanger base brackets (FIG. 1, FIG. 2, and FIG. 3), the pair of diagonal braces rests at least in part within the stacking slots of a heat exchanger base bracket below.

A set of heat exchanger base brackets (e.g., FIG. 4A to FIG. 4C) include at least one of each of three types of brackets including: a fixed height heat exchanger bracket (e.g. FIG. 4A), a bottom bracket having a plurality of levels of different height mounting holes which can also be used as a fixed height bracket (e.g., FIG. 4B), and a top bracket (e.g., top bracket of FIG. 4C, or FIG. 4D, or FIG. 4D) having a plurality of mounting holes or bottom slots at or near a lower edge of each side of the top bracket for mounting to either side of the bottom bracket having a plurality of levels of height adjustment positions. When the bottom bracket having the plurality of levels of height adjustment positions is used as a part of a two-part adjustable bracket, the number of available base bracket settable heights (e.g., FIG. 4A to FIG. 4E) is greater than three.

A heat shield 1500, FIG. 14, for a heat exchanger cabinet (e.g., heat exchanger cabinet 1300, FIG. 12) includes a forward lower skirt 1501, an about flat or low angle surface front to rear 1503, an about vertical chimney sheet 1505, and an upper rear discharge fin 1507.

The heat shield can further include mounting ears 1509 at either side of a forward portion of the about flat or low angle surface front to rear.

Figure 21:
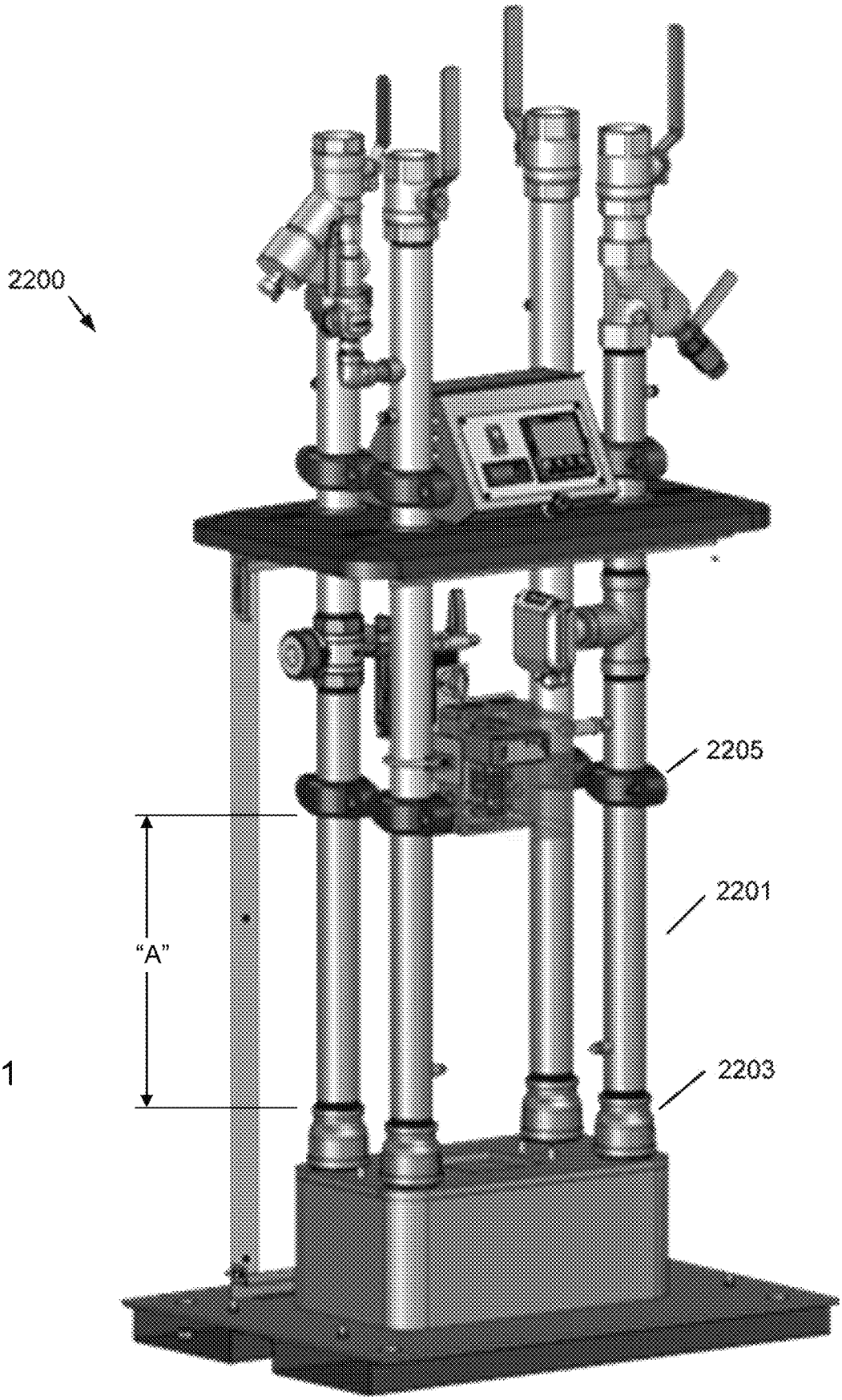
FIG. 21 shows another approach to solving the problem of vertically mounting a heat exchanger in a universal cabinet.
Figure 22:
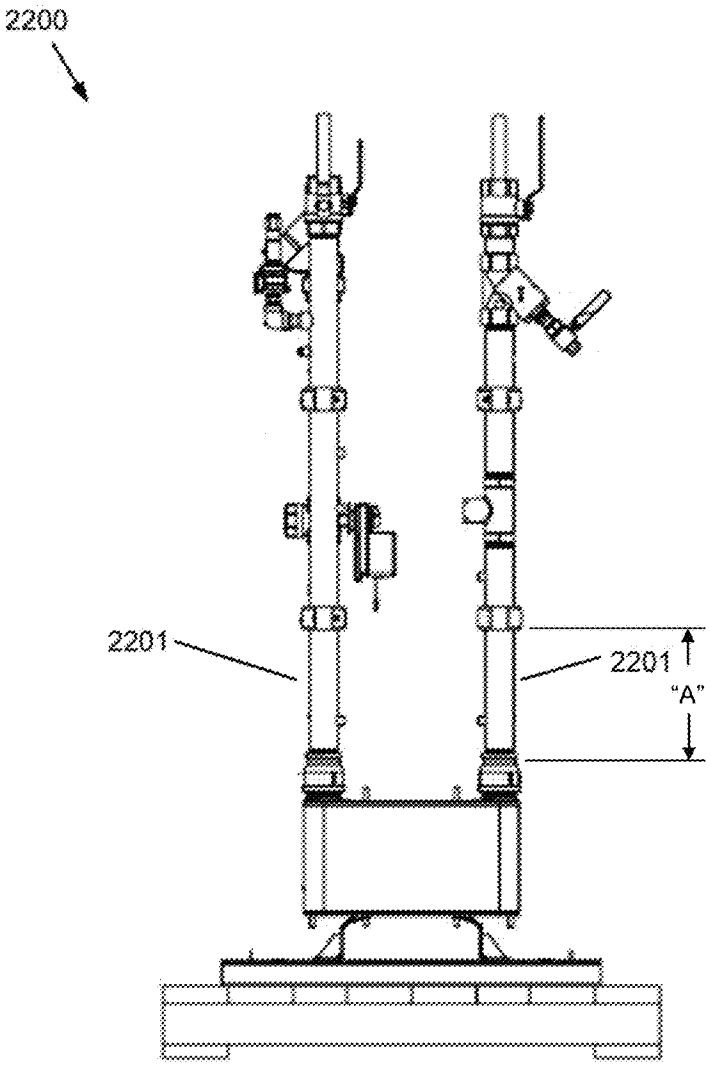
FIG. 22 is drawing showing the exemplary cabinet (sides not shown) which optional pipe "A" lengths shown to the right for various heights of similar type heat exchangers mounted vertically in the cabinet.

FIG. 21 shows another approach to solving the problem of vertically mounting a heat exchanger in another universal cabinet. FIG. 21 is a drawing showing the internal parts of a universal cabinet (sides not shown) where the heat exchanger sits on the bottom of the cabinet, typically on a skid, such as, for example, a reinforced or corrugated skid. Rather than move the base of the heat exchanger for different heat exchanger heights as with the brackets described hereinabove, now the heat exchanger sits on a bottom surface, and the connecting pipes 2201 between the pipe connectors 2203 of the stacks of the heat exchanger and pipe clamps 2205 vary in length (of selectable fixed lengths) so that that piped connections at the top of the cabinet are always at about the same height as described hereinabove. FIG. 22 is drawing showing the exemplary cabinet (sides not shown) which optional pipe "A" lengths shown to the right for various heights of similar type heat exchangers mounted vertically in the cabinet.

Any software and/or firmware to operate a heat exchanger as described hereinabove (e.g., controls, instrumentation, sensors, actuators, controlled valves, etc.) can be provided on a computer readable non-transitory storage medium. A computer readable non-transitory storage medium as non-transitory data storage includes any data stored on any suitable media in a non-fleeting manner. Such data storage includes any suitable computer readable non-transitory storage medium, including, but not limited to hard drives, non-volatile RAM, SSD devices, CDs, DVDs, etc.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A heat exchanger cabinet system for a vertically mounted heat exchanger, the heat exchanger cabinet system comprising:

a heat exchanger cabinet including a base pallet;

a heat exchanger mountable to the base pallet;

top mounted fluid inlet and outlet ports disposed at a predetermined vertical height relative to the base pallet and positioned for coupling to plumbed connections associated with a structure or building;

a plurality of heat exchanger connecting pipes to provide fluid connections between the heat exchanger and the top mounted fluid inlet and the fluid outlet ports, wherein a first set of the plurality of heat exchanger connecting pipes comprises a first length and a second set of the plurality of heat exchanger connecting pipes comprises a second length different from the first length;

wherein a given set of the first set and the second set of the plurality of heat exchanger connecting pipes is selected such that respective lengths of the heat exchanger connecting pipes of the given set enables coupling and assembling relative to the heat exchanger and to the top mounted fluid inlet and outlet ports disposed at the predetermined vertical.

2. The heat exchanger cabinet system of claim 1 wherein the first set of heat exchanger connecting pipes include multiple first heat exchanger pipes having the first length and the second set of heat exchanger connecting pipes include multiple second heat exchanger connecting pipes having the second length.

3. The heat exchanger cabinet system of claim 2 wherein at least a third set of heat exchanger connecting pipes of the plurality of heat exchanger connecting pipes comprise a third length different from the first length of the first heat exchanger connecting pipe and the second length of the second heat exchanger connecting pipes.

4. The heat exchanger cabinet system of claim 3 including a third set of heat exchanger pipes having multiple third heat exchanger connecting pipes.

5. The heat exchanger cabinet system of claim 3 including multiple heat exchangers, the multiple heat exchangers defining multiple vertical heights, wherein the given set of the first set and the second set of the plurality of heat exchanger connecting pipes is selected to cooperate with a selected heat exchanger of the multiple heat exchanges to enable to the fluid inlet and outlet ports.

6. The heat exchanger cabinet system of claim 5 wherein a first heat exchanger of the multiple heat exchangers defines a first height and a second heat exchanger of the multiple heat exchangers defines a second height different from the first height.

7. The heat exchanger cabinet system of claim 6 wherein the first heat exchanger is couplable to the first set of heat exchanger connecting pipes for coupling to the top mounted fluid inlets and outlets disposed at the predetermined vertical height relative to the base pallet.

8. The heat exchanger cabinet system of claim 7 wherein the second heat exchanger is couplable to the second set of heat exchanger connecting pipes for coupling to top mounted fluid inlets and outlets disposed at the predetermined vertical height relative to the base pallet.

9. The heat exchanger cabinet system of claim 1 wherein the heat exchanger cabinet includes the plurality of top mounted fluid inlets and outlets.

10. The heat exchanger cabinet system of claim 1 including one or more skirt portions covering at least one side of the base pallet.

11. The heat exchanger cabinet system of claim 1 wherein the heat exchanger connecting pipes are substantially rigid.

12. The heat exchanger cabinet system of claim 1 including a plurality of heat exchangers, the plurality of heat exchangers defining different vertical heights.

* * * * *